US010500874B2

(12) United States Patent
Otsuka et al.

(10) Patent No.: US 10,500,874 B2
(45) Date of Patent: Dec. 10, 2019

(54) RECORDING APPARATUS

(71) Applicant: SEIKO EPSON CORPORATION, Tokyo (JP)

(72) Inventors: Kazuo Otsuka, Azumino (JP); Yosuke Nakano, Matsumoto (JP); Eiji Taketsugu, Matsumoto (JP); Atsuhiko Takeuchi, Matsumoto (JP); Kazuhisa Kawakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/144,943

(22) Filed: Sep. 27, 2018

(65) Prior Publication Data

US 2019/0092051 A1 Mar. 28, 2019

(30) Foreign Application Priority Data

Sep. 28, 2017 (JP) ..... 2017-187591

(51) Int. Cl.

| | |
|---|---|
| ***B41J 11/00*** | (2006.01) |
| ***B41J 2/17*** | (2006.01) |
| ***B41J 11/06*** | (2006.01) |
| ***B41J 2/21*** | (2006.01) |
| ***B41J 29/02*** | (2006.01) |
| ***B41J 29/13*** | (2006.01) |

(52) U.S. Cl.

CPC ..... *B41J 11/0065* (2013.01); *B41J 2/1721* (2013.01); *B41J 2/2107* (2013.01); *B41J 11/005* (2013.01); *B41J 11/06* (2013.01); *B41J 29/02* (2013.01); *B41J 29/13* (2013.01); *B41J 2002/1742* (2013.01)

(58) Field of Classification Search

CPC .... B41J 2/1721; B41J 2/2107; B41J 11/0065; B41J 11/06; B41J 29/02; B41J 29/13; B41J 2002/1742

See application file for complete search history.

(56) References Cited

U.S. PATENT DOCUMENTS 5,731,829 A * 3/1998 Saito ..... B41J 3/36 347/104
2006/0023052 A1 2/2006 Watanabe et al.
(Continued)

FOREIGN PATENT DOCUMENTS

JP 4375552 B 2/2006
JP 4420247 B 10/2008
(Continued)

*Primary Examiner* — Anh T Vo
(74) *Attorney, Agent, or Firm* — Workman Nydegger

(57) ABSTRACT

In a support member that is disposed to face a liquid emitting head and supports a medium, in a first region through which an edge of a first medium in a medium width direction passes, a liquid receiving portion is provided which receives a liquid emitted on a region deviated from the edge of the first medium in the medium width direction, and in a second region as a region through which an edge of a second medium in which a size thereof in the medium width direction is larger than that of the first medium passes, an absorbing material disposing portion at which a liquid absorbing material which absorbs the liquid guided from the liquid receiving portion is disposed to be capable of being exposed from an upper side of the support member is provided.

7 Claims, 25 Drawing Sheets

(56) References Cited

U.S. PATENT DOCUMENTS

| | | | | |
|---|---|---|---|---|
| 2006/0268087 | A1* | 11/2006 | Sasa | B41J 2/175<br>347/101 |
| 2008/0238994 | A1 | 10/2008 | Ota | |
| 2009/0109265 | A1 | 4/2009 | Terada | |
| 2012/0134733 | A1 | 5/2012 | Ota et al. | |
| 2017/0348986 | A1 | 12/2017 | Tsukuda et al. | |

FOREIGN PATENT DOCUMENTS

| | | | |
|---|---|---|---|
| JP | 4894726 | B | 5/2009 |
| JP | 4893658 | B | 1/2012 |
| JP | 4900284 | B | 1/2012 |
| JP | 5621556 | B | 6/2012 |
| JP | 5630244 | B | 6/2012 |
| JP | 5904076 | B | 3/2016 |
| JP | 2017-030284 | A | 2/2017 |

* cited by examiner

RECORDING APPARATUS

BACKGROUND

1. Technical Field

The present invention relates to a recording apparatus for recording on a medium.

2. Related Art

In recording apparatuses which are represented by facsimile machines, printers and the like, particularly ink jet printers, a recording apparatus that is configured to be capable of performing so-called marginless recording which records without margins on the four sides of recording paper is widely known.

In the marginless recording, ink is also emitted on a region deviated from edges of the recording paper (ink is discarded). Therefore, a structure for discarding the ink is provided in a guide member (also referred to as platen) which is provided to face the ink jet recording head and supports the recording paper.

In the printing apparatus described in JP-A-2017-030284, an ink receiver is provided on a surface of a platen, and excess ink landed on the ink receiver is guided to an ink absorber provided on a downstream side in a sheet transport direction. In addition, another ink absorber is provided on a back side of the platen, and the ink absorber is in contact with the ink absorber provided on the downstream side of a platen surface in the transport direction, thereby increasing the capacity of the ink absorber.

In a configuration that does not assume that the ink absorber is exchanged by the user himself/herself, when the ink absorbing capacity of the ink absorber reaches the limit, it is handled by the manufacturer for maintenance (repair). Accordingly, it is preferable that the workability when exchanging the ink absorber be good, but in the printing apparatus described in JP-A-2017-030284, in order to replace the ink absorber disposed on the back side of the platen, since it is necessary to remove the platen, workability is inferior.

In addition, if the ink absorber is used as only the ink absorber provided on a downstream side in the sheet transport direction in the printing apparatus described in the JP-A-2017-030284, the ink absorbing capability is insufficient. In addition, if the ink absorber is extended to the downstream side in the sheet transport direction in order to improve the ink absorbing capacity, a transport path extends to increase the size of the apparatus, and conversely, if the ink absorber is extended to the upstream side in the sheet transport direction, the ink absorber hits the ink discarding region. If there is an ink absorber in the ink discarding region, there is a fear that the back side of the sheet is contaminated due to contact of the ink absorber to the back side of the sheet.

SUMMARY

An advantage of some aspects of the invention is to provide a recording apparatus which takes into consideration both of good exchangeability of an ink absorbing material and adequate securing of an ink absorbing capacity.

According to an aspect of the invention, there is provided a recording apparatus including: a liquid emitting head that emits a liquid on a medium; and a support member that is disposed to face the liquid emitting head and supports the medium, in which, in the support member, in first regions as regions through which an edge of a first medium passes in a medium width direction as a direction intersecting a medium transport direction, a liquid receiving portion is provided which receives the liquid emitted on a region deviated from the edge of the first medium in the medium width direction, and in a second region as a region through which an edge of a second medium in which a size thereof in the medium width direction is larger than that of the first medium passes, an absorbing material disposing portion at which a liquid absorbing material which absorbs the liquid guided from the liquid receiving portion is disposed to be capable of being exposed from an upper side of the support member is provided.

With this configuration, since, in the first regions through which the edge (hereinafter referred to as "side end edge") of the first medium in the medium width direction passes, the liquid receiving portion is provided which receives liquid emitted on the region deviated from the side end edge of the first medium, and in the second region as the region through which the side end edge of the second medium in which the size thereof in the medium width direction is larger than that of the first medium, the absorbing material disposing portion which disposes the liquid absorbing material which absorbs liquid guided from the liquid receiving portion to be capable of being exposed from the upper side of the support member, it is possible to secure a volume of the liquid absorbing material as compared with a configuration in which the absorbing material disposing portion is provided on the upstream side or the downstream side in the medium transport direction with respect to the liquid receiving portion. Moreover, since the liquid absorbing material is disposed at a position where the liquid absorbing material can be exposed from the upper side of the support member, exchangeability is also good.

Further, as for the size of the medium, there is a case where the demand for marginless recording is high (for example, a photographic paper size) and a case where the demand for marginless recording is lower (for example, A4 size paper) than the former case. Therefore, by configuring the recording apparatus setting the former as the size of the first medium and the latter as the size of the second medium, for example, it is possible to obtain an appropriate recording apparatus corresponding to user needs.

In the recording apparatus, in the first aspect, the absorbing material disposing portion may be provided on both sides of the liquid receiving portion in the medium width direction.

With this configuration the absorbing material disposing portions are provided on both sides of the liquid receiving portion in the medium width direction, the operation and effect of the first aspect described above can be obtained.

In the recording apparatus, the liquid receiving portion may be provided corresponding to edges on both sides of the first medium in the medium width direction, and a third region as a region between the two liquid receiving portions in the medium width direction may be configured as a liquid receiving portion which receives the liquid emitted in a region deviated from the edge of the first medium in the medium transport direction.

With this configuration, the marginless recording can be performed on the edge of the first medium in the medium transport direction by using the third region.

In the recording apparatus, the support member may be provided with a guide portion which guides the liquid from the liquid receiving portion to the absorbing material disposing portion.

With this configuration, since the guide portion which guides the liquid from the liquid receiving portion to the absorbing material disposing portion is provided, the support member can suppress the retention of the liquid in the liquid receiving portion.

In the recording apparatus, the recording apparatus may further comprise a medium receiving tray which receives the medium discharged after recording, an upstream side of the medium receiving tray in the medium transport direction may be positioned under the support member, and the absorbing material disposing portion may overlap the medium receiving tray in an apparatus height direction.

With this configuration, since the recording apparatus further comprises a medium receiving tray which receives the discharged medium after recording, an upstream side of the medium receiving tray in the medium transport direction is positioned under the support member, and the absorbing material disposing portion overlaps the medium receiving tray in an apparatus height direction, a region on the side of the medium receiving tray is used as the absorbing material disposing portion, and as a result, it is possible to secure a large size of the absorbing material disposing portion so that the liquid absorption capability can be greatly improved.

In the recording apparatus, the liquid absorbing material disposed in the absorbing material disposing portion may be held by a holding member having a flange portion.

With this configuration, since the liquid absorbing material is held by the holding member having the flange portion, the liquid absorbing material can be securely held with a simple structure.

In the recording apparatus, a groove extending in the medium width direction may be provided on at least one of the upstream side and the downstream side in the medium transport direction in the liquid receiving portion.

With this configuration, since the grooves extending in the medium width direction are provided on at least one of the upstream side and the downstream side in the medium transport direction in the liquid receiving portion, when the device is inclined, It is possible to prevent or suppress the outflow of the liquid from the liquid receiving portion (outflow in medium transport direction).

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
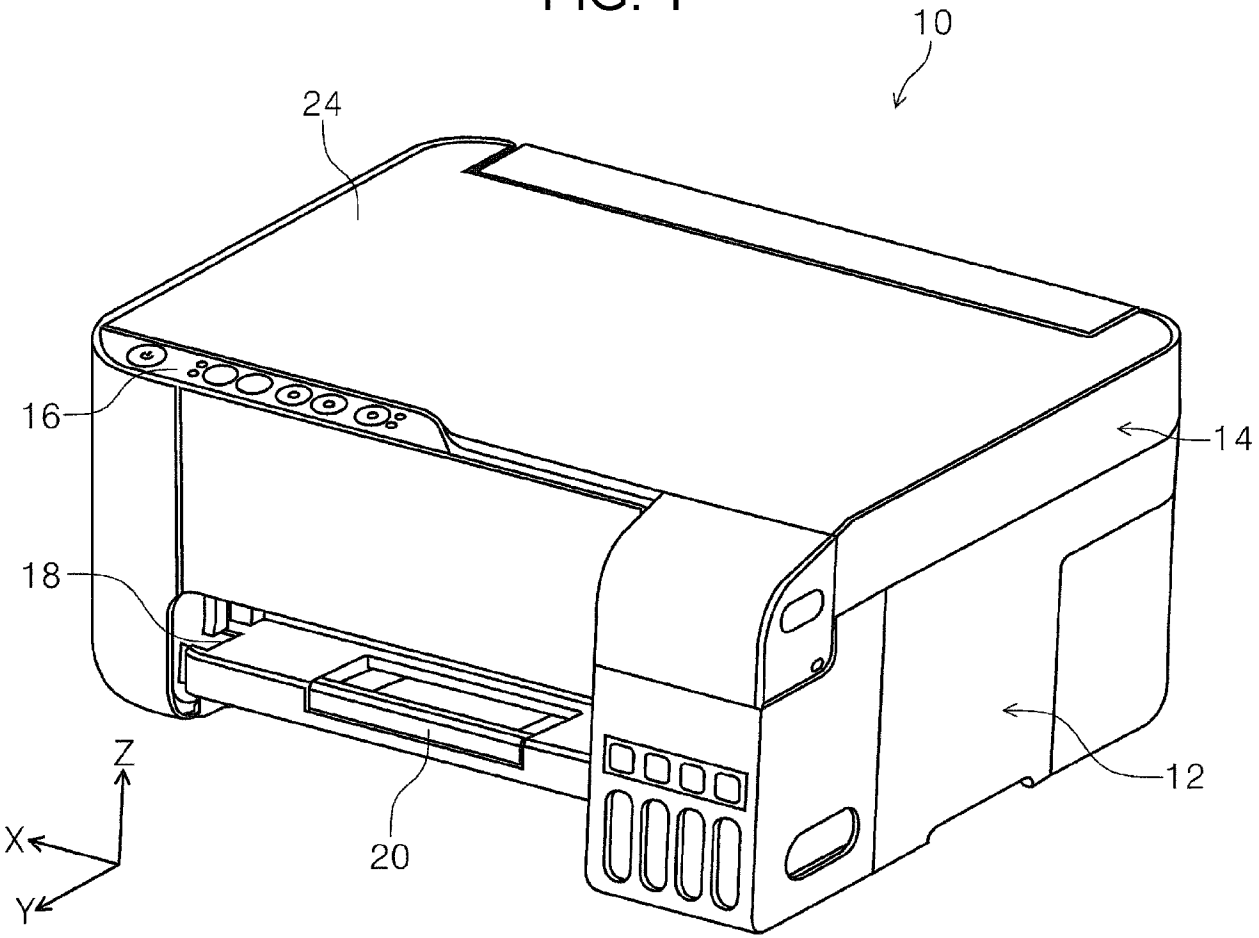
FIG. 1 is an external perspective view illustrating a printer according to a first embodiment.

Hereinafter, embodiments of the invention will be described with reference to the drawings. In each of the embodiments, the same components are denoted by the same reference numerals, and will be described only in a first embodiment, and the description of the configuration thereof will be omitted in the following embodiments.

Figure 2:
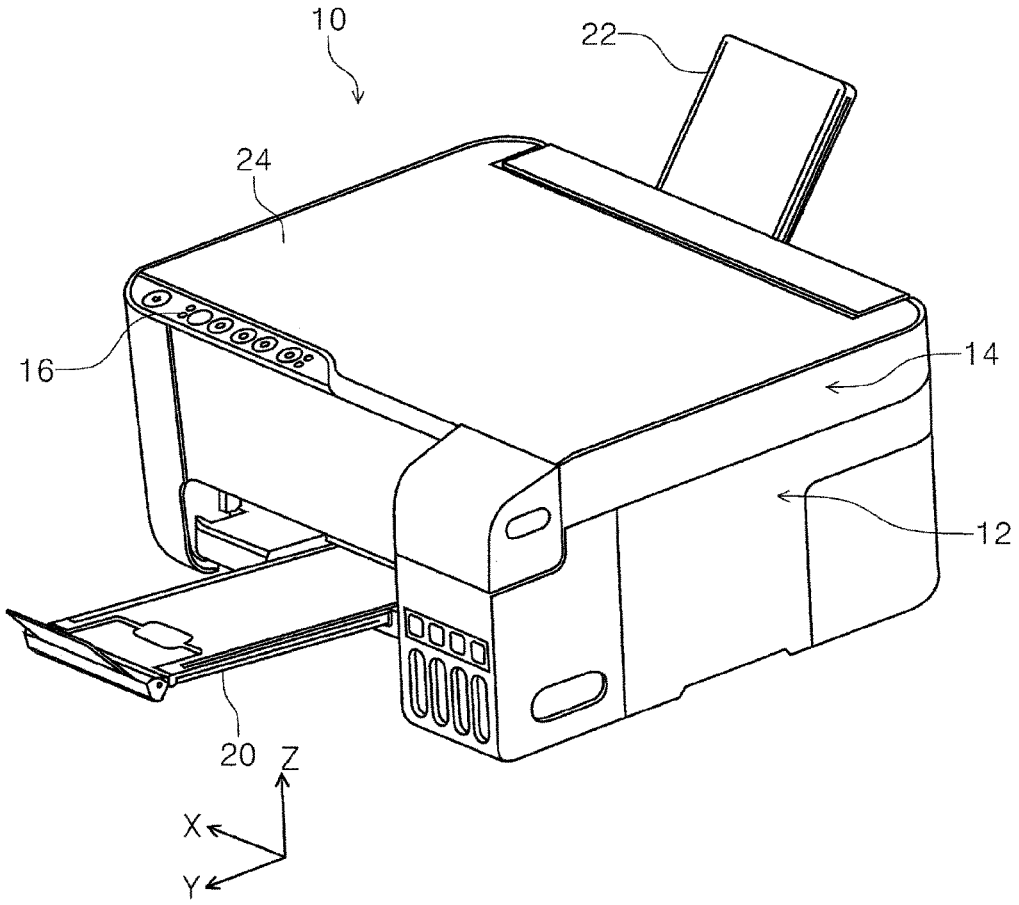
FIG. 2 is a perspective view illustrating a state where a medium support tray and a medium receiving tray in the printer according to the first embodiment are developed.
Figure 3:
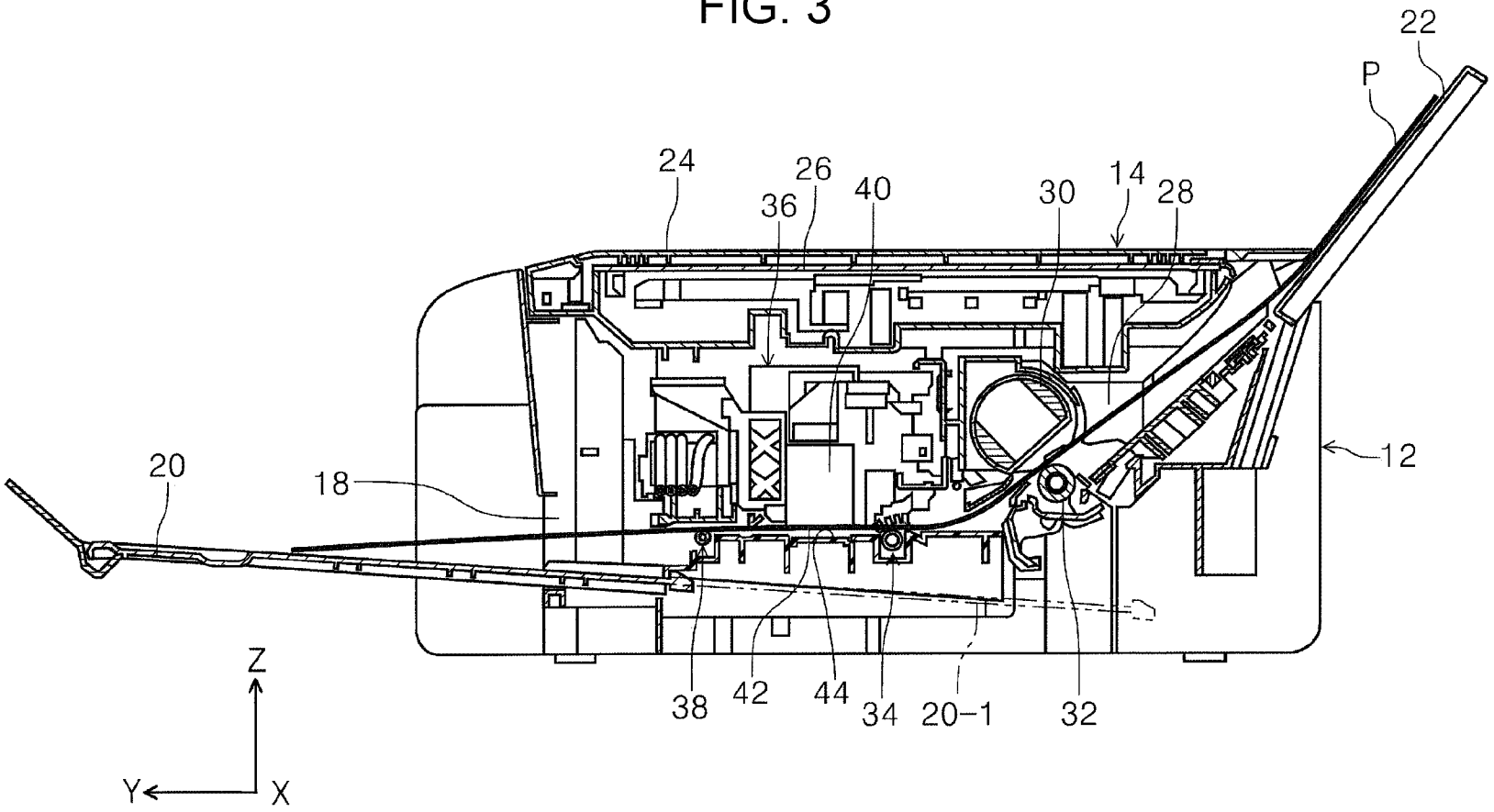
FIG. 3 is a side cross-sectional view illustrating a medium transport path of the printer according to the first embodiment.
Figure 4:
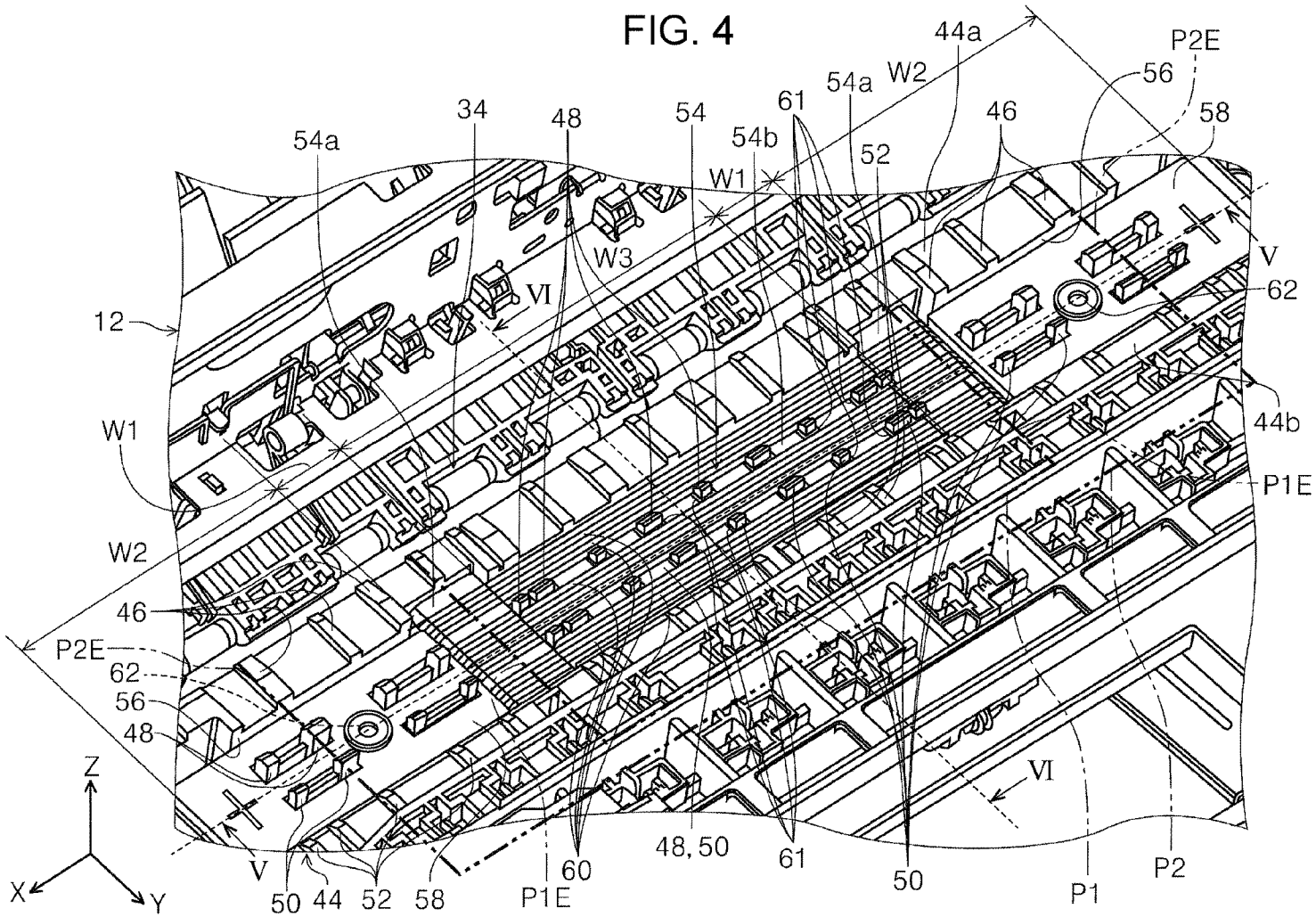
FIG. 4 is a perspective view illustrating a support member in a medium transport path of the printer according to the first embodiment.

FIG. 1 is an external perspective view illustrating a printer according to a first embodiment, FIG. 2 is a perspective view illustrating a state where a medium support tray and a medium receiving tray in the printer according to the first embodiment are developed, FIG. 3 is a side cross-sectional view illustrating a medium transport path of the printer according to the first embodiment, and FIG. 4 is a perspective view illustrating a support member in a medium transport path of the printer according to the first embodiment.

Figure 5:
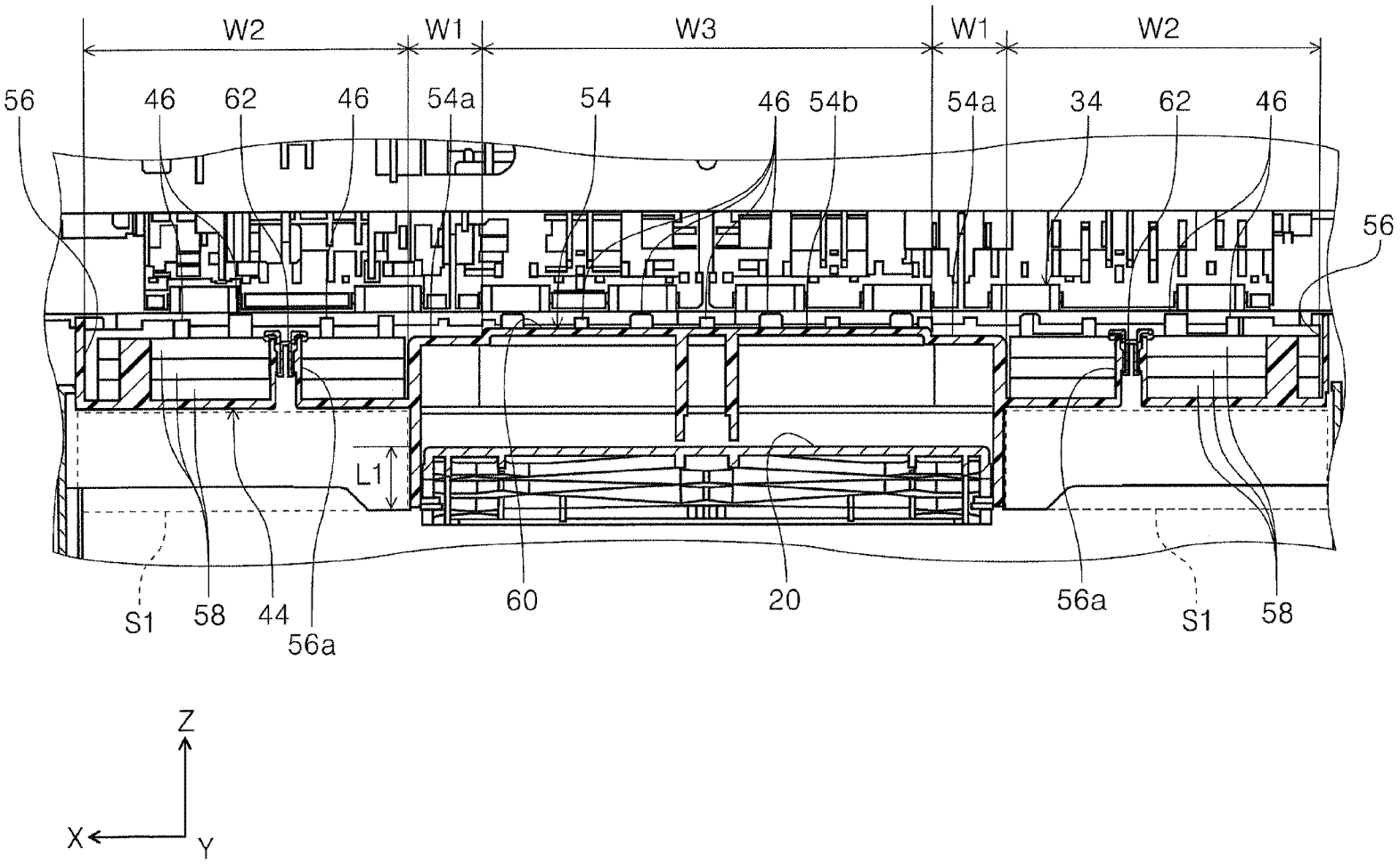
FIG. 5 is a cross-sectional view taken along line V-V in FIG. 4.
Figure 6:
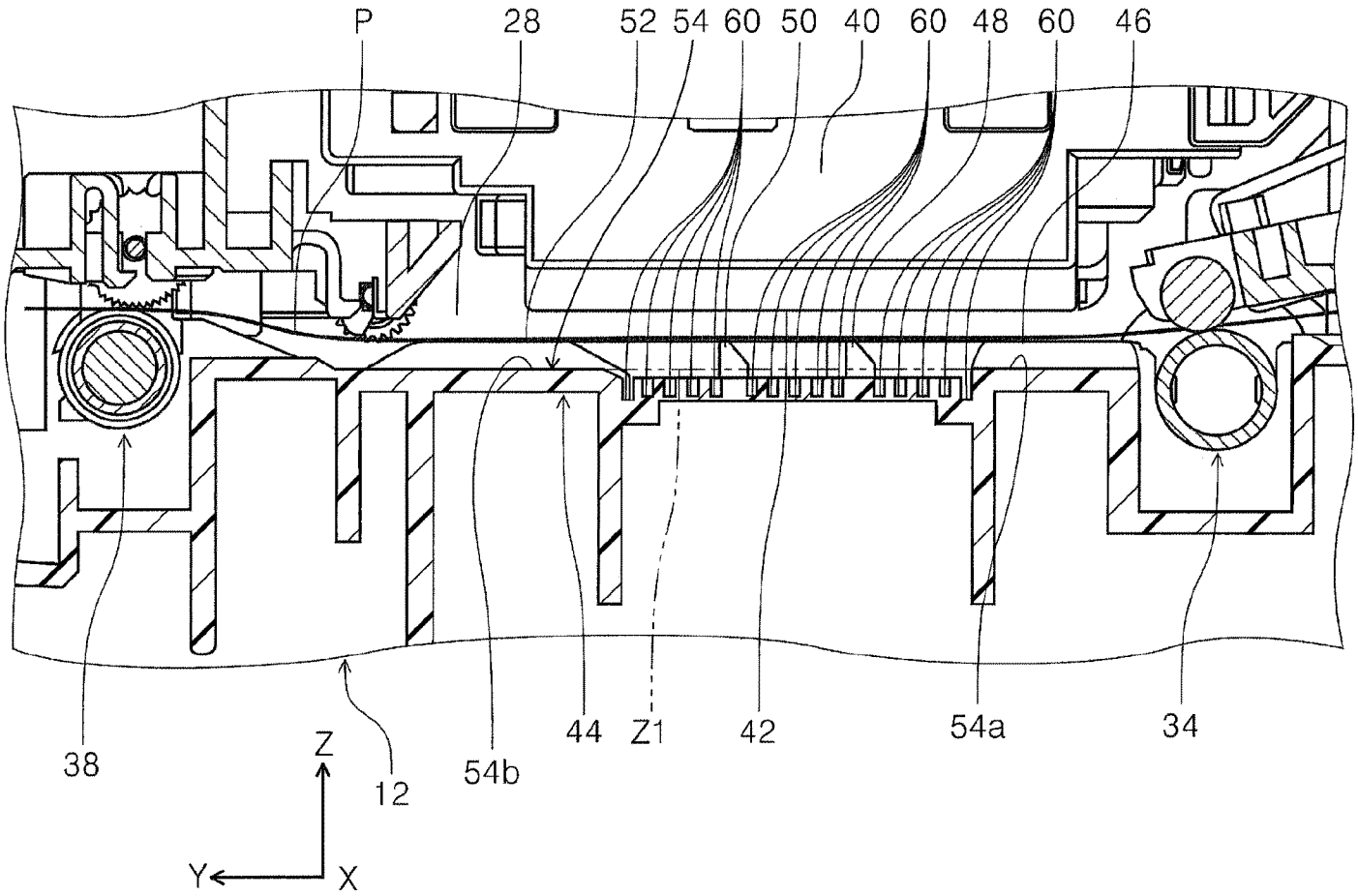
FIG. 6 is a cross-sectional view taken along line VI-VI of FIG. 4.
Figure 7:
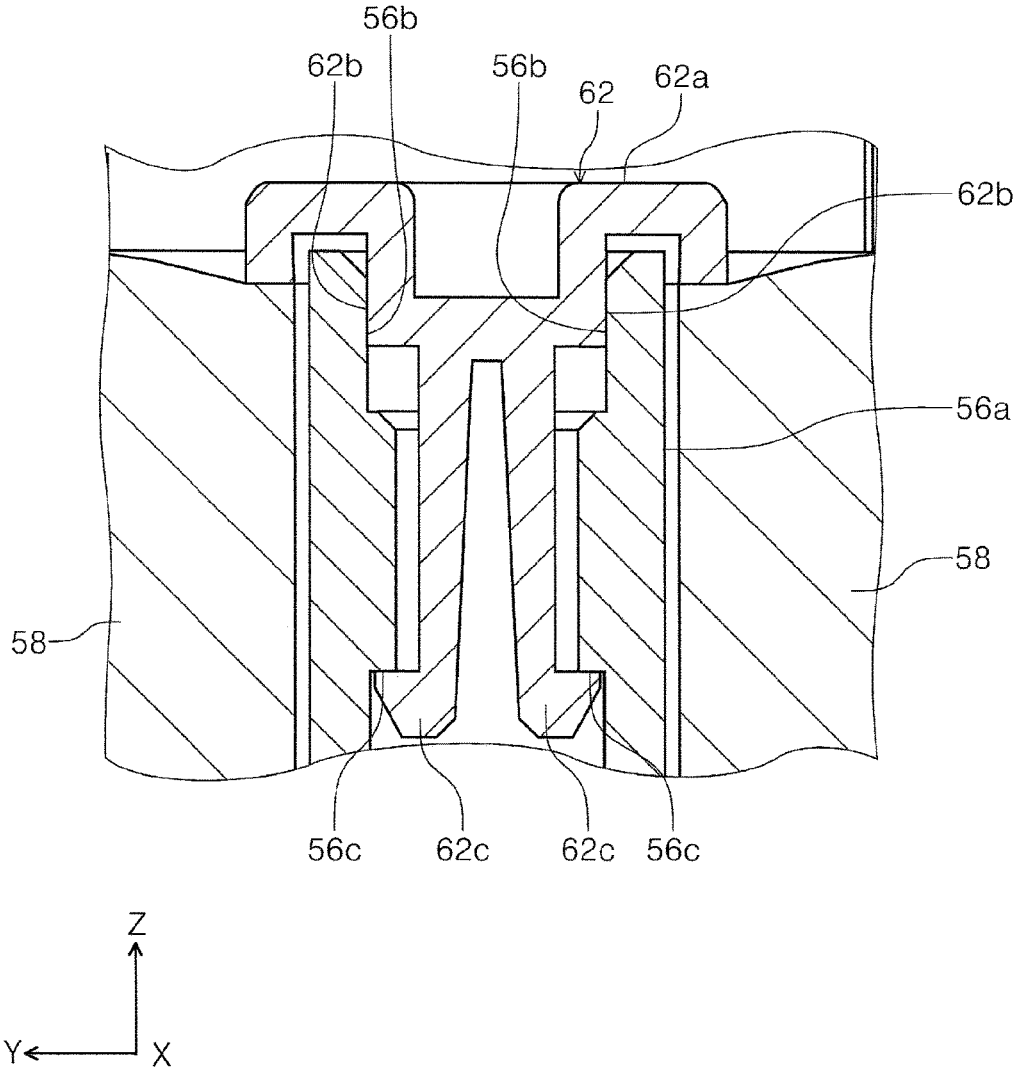
FIG. 7 is a side cross-sectional view illustrating a holding member.
Figure 8:
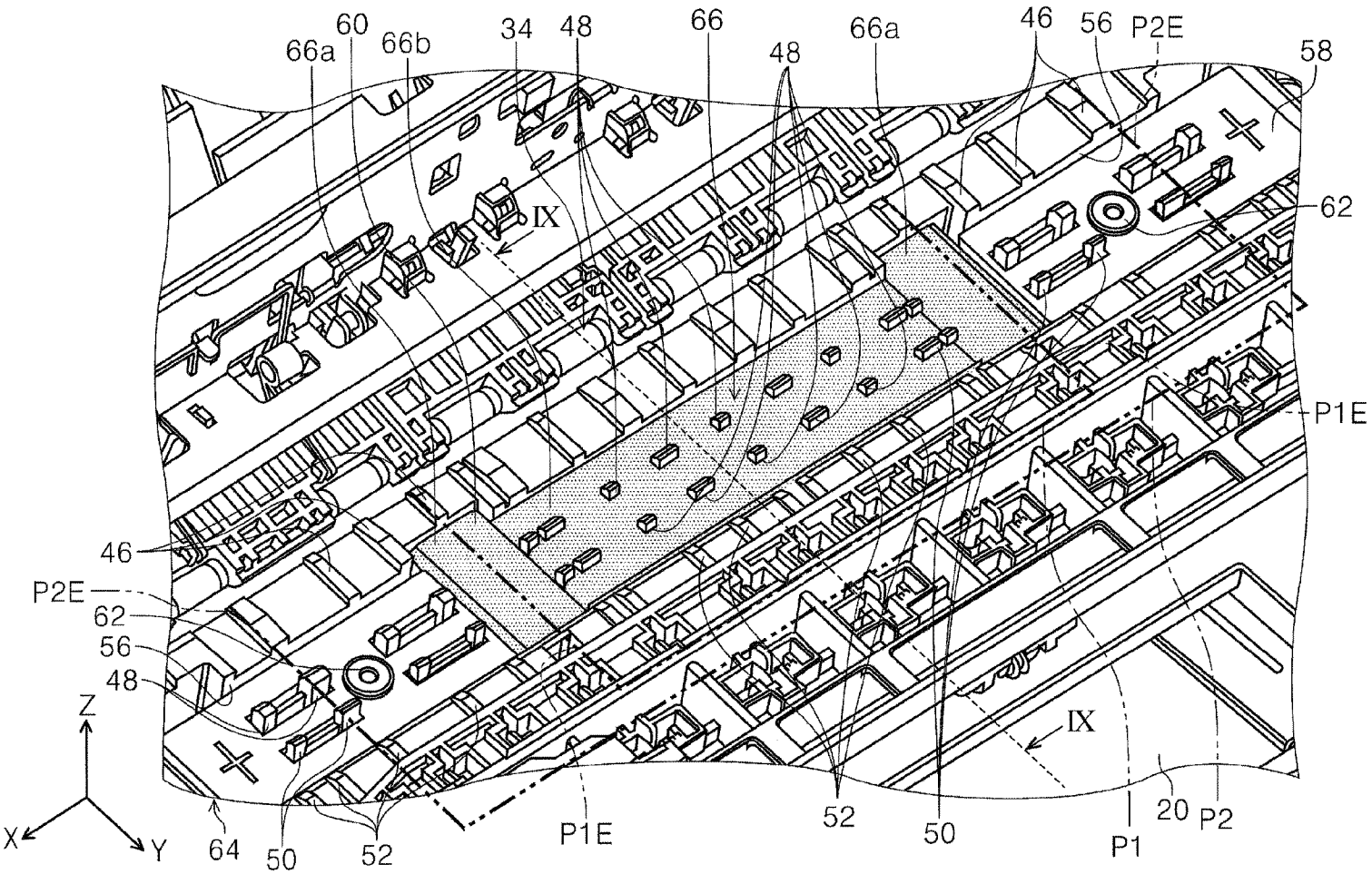
FIG. 8 is a perspective view of a support member according to a second embodiment.
Figure 9:
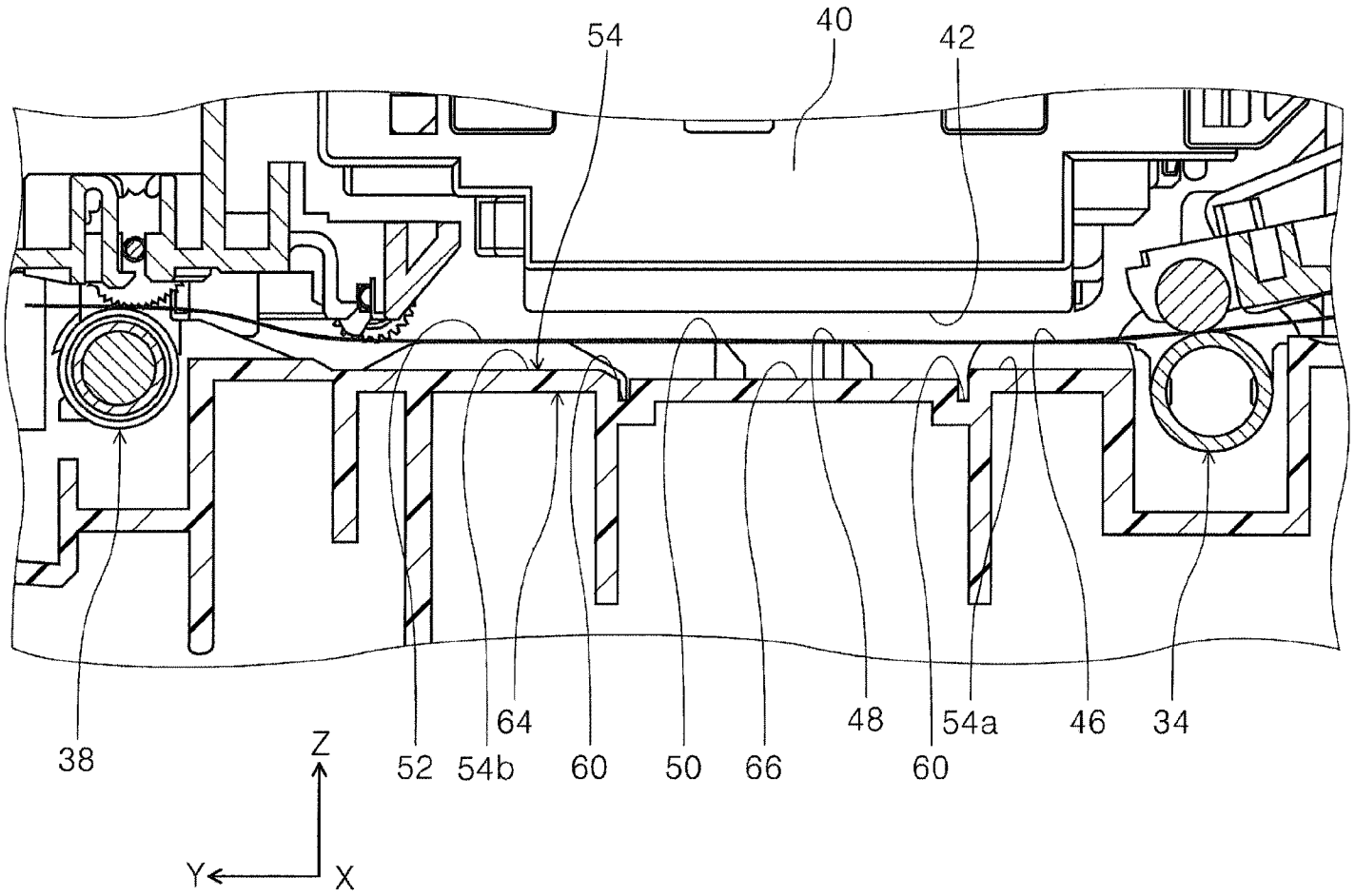
FIG. 9 is a cross-sectional view taken along line IX-IX of FIG. 8.
Figure 10:
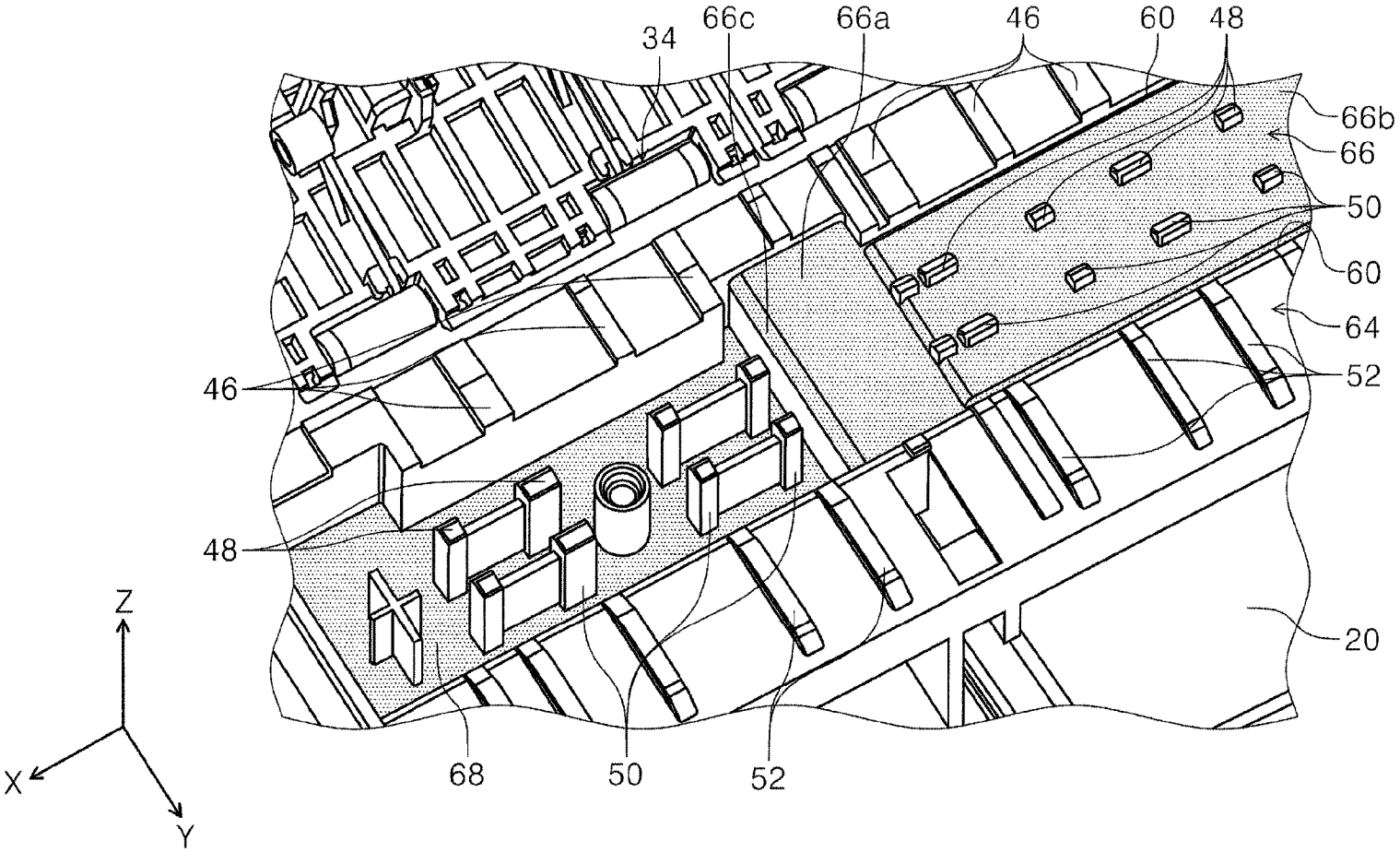
FIG. 10 is a perspective view illustrating an example of modification examples of an absorbing material disposing portion according to the second embodiment.

FIG. 5 is a cross-sectional view taken along line V-V in FIG. 4, FIG. 6 is a cross-sectional view taken along line VI-VI of FIG. 4, FIG. 7 is a side cross-sectional view illustrating a holding member, FIG. 8 is a perspective view of a support member according to a second embodiment, FIG. 9 is a cross-sectional view taken along line IX-IX of FIG. 8, and FIG. 10 is a perspective view illustrating an example of modification examples of an absorbing material disposing portion according to the second embodiment.

Figure 11:
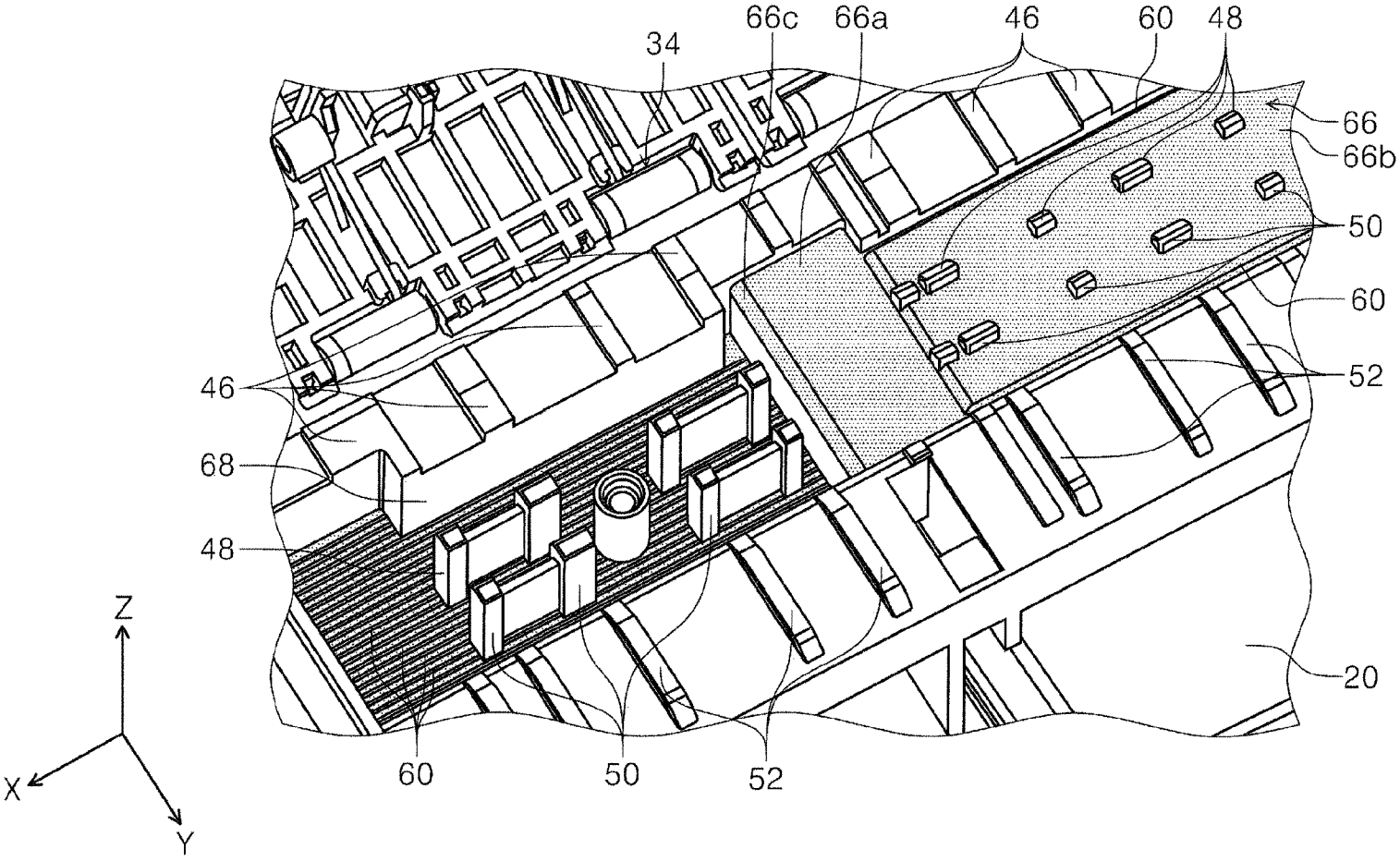
FIG. 11 is a perspective view illustrating another example of modification examples of the absorbing material disposing portion according to the second embodiment.
Figure 12:
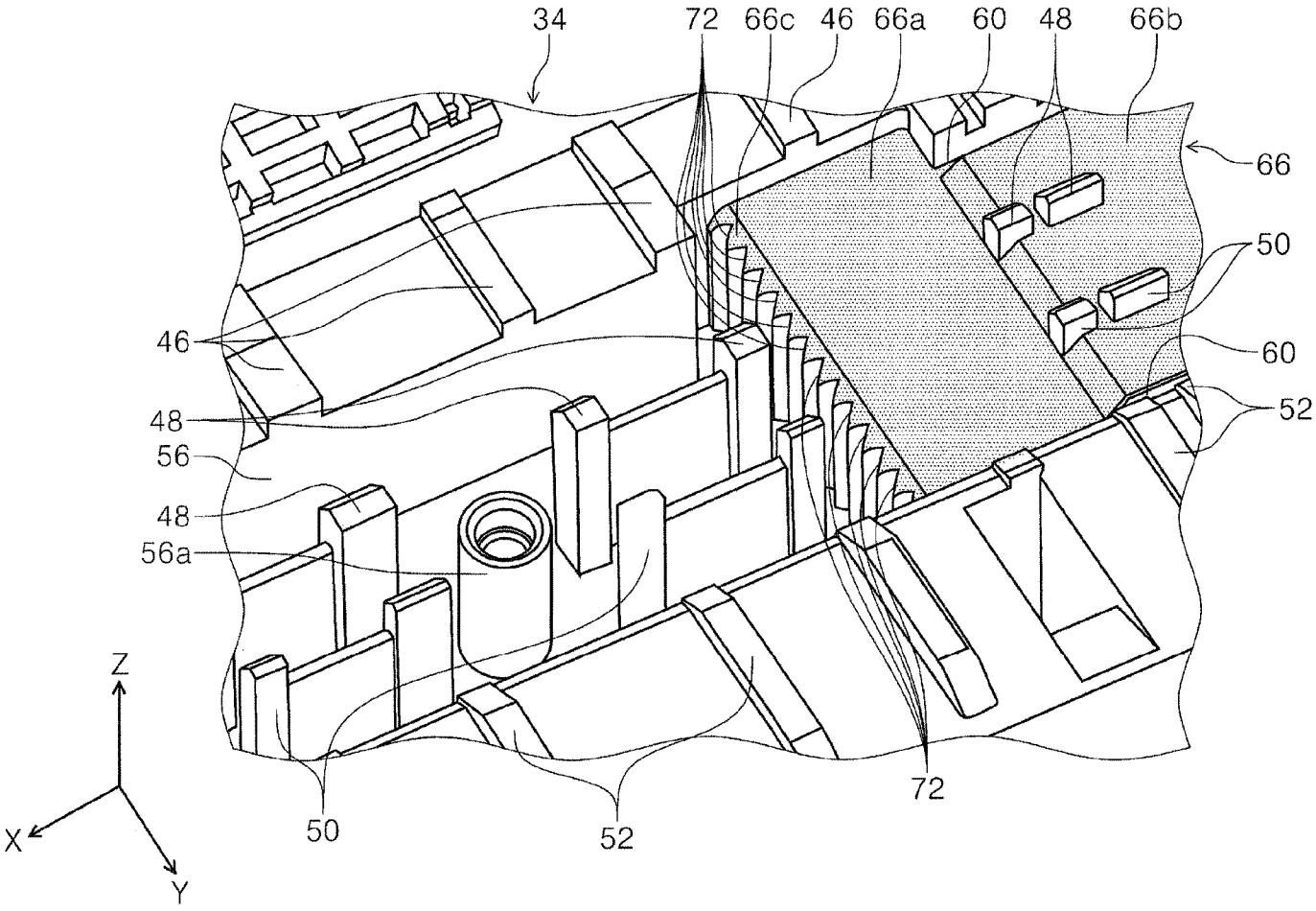
FIG. 12 is a perspective view illustrating an example of modification examples of the liquid receiving portion according to the second embodiment.
Figure 13:
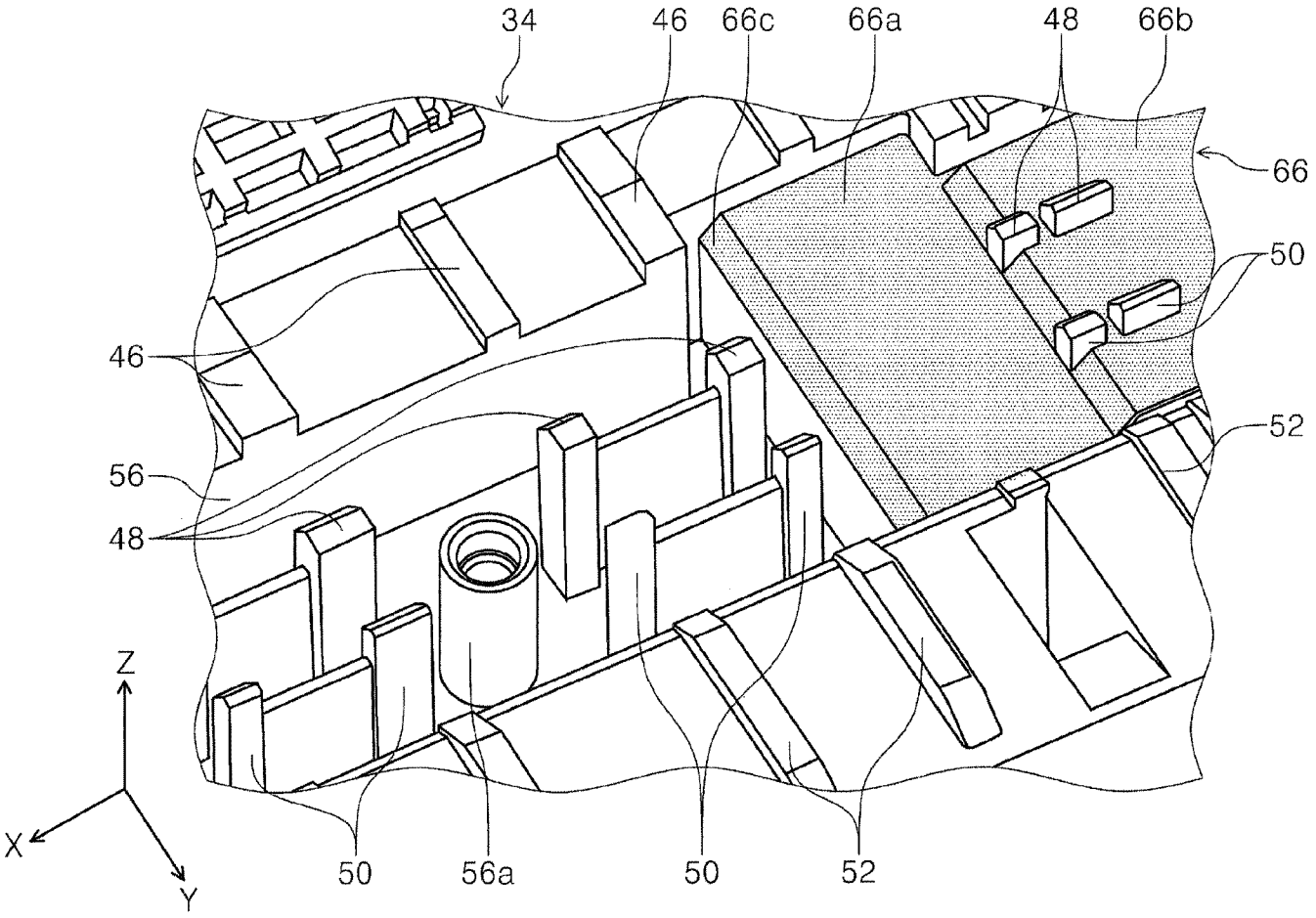
FIG. 13 is a perspective view illustrating another example of modification examples of the liquid receiving portion according to the second embodiment.
Figure 14:
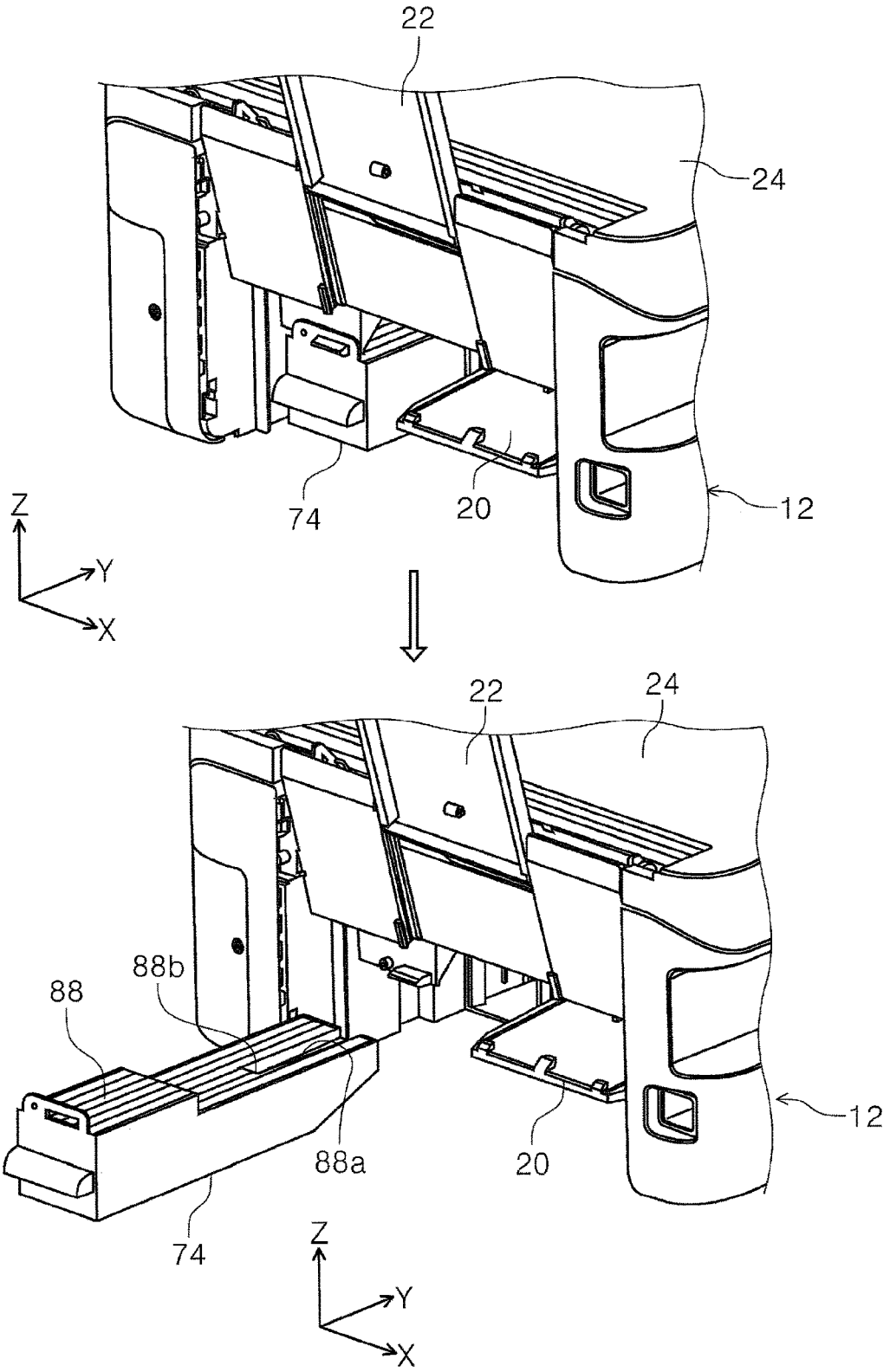
FIG. 14 is a perspective view illustrating attachment and detachment of a waste liquid accommodation container according to a third embodiment to and from a printer.

FIG. 11 is a perspective view illustrating another example of modification examples of the absorbing material disposing portion according to the second embodiment, FIG. 12 is a perspective view illustrating an example of modification examples of the liquid receiving portion according to the second embodiment, FIG. 13 is a perspective view illustrating another example of modification examples of the liquid receiving portion according to the second embodiment, and FIG. 14 is a perspective view illustrating attachment and detachment of a waste liquid accommodation container according to a third embodiment to and from a printer.

Figure 15:
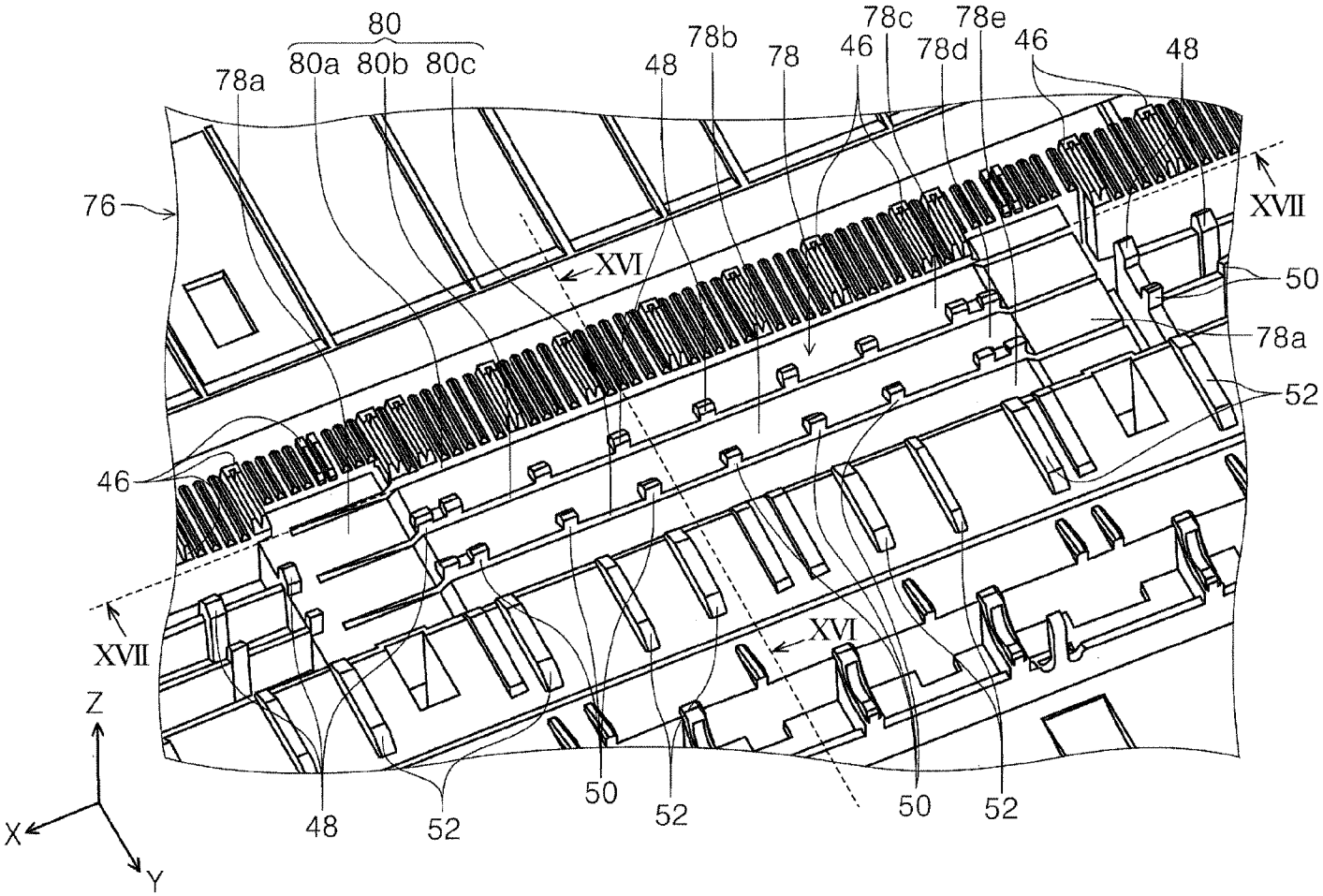
FIG. 15 is a perspective view illustrating a support member according to the third embodiment.
Figure 16:
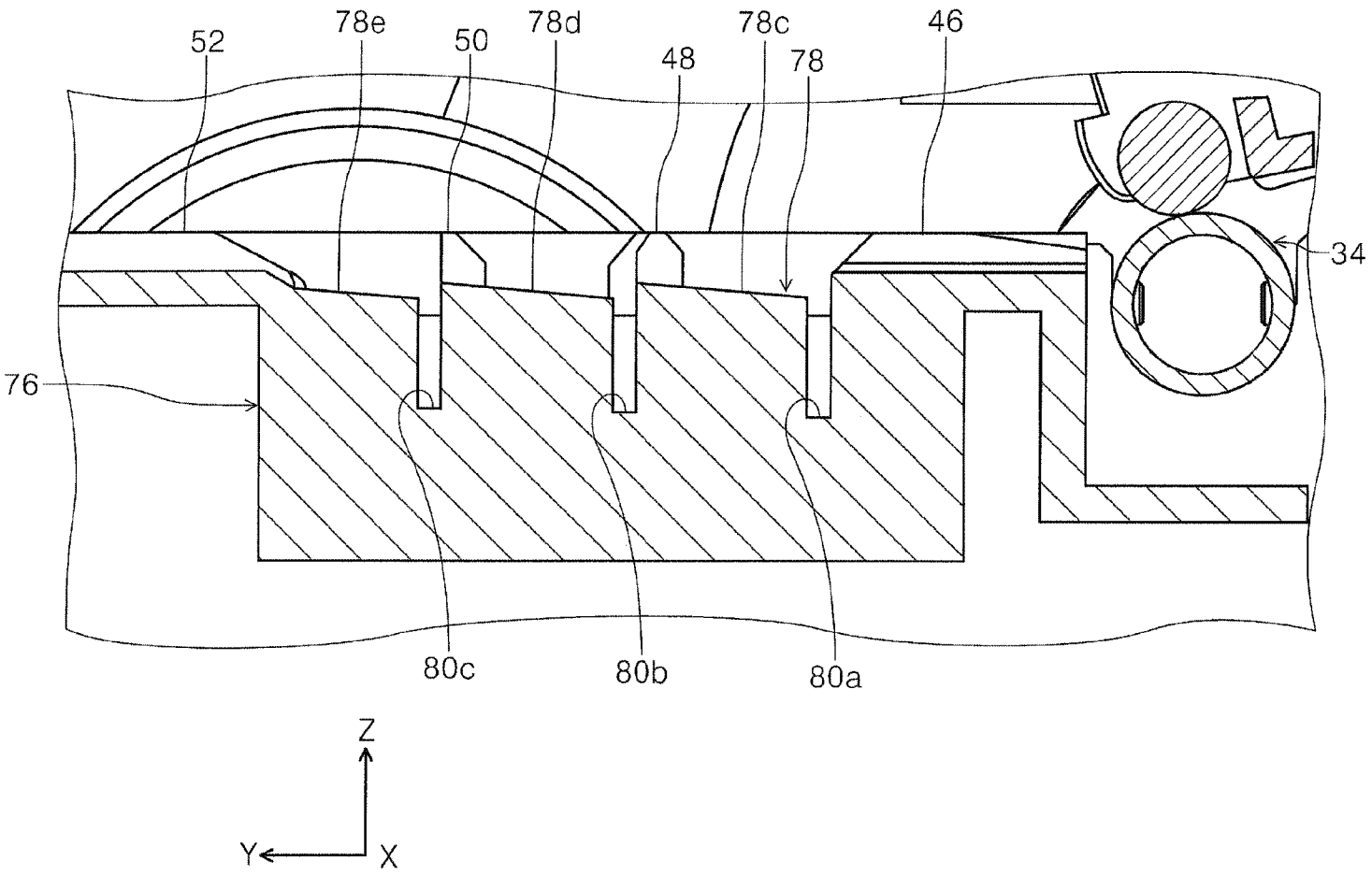
FIG. 16 is a cross-sectional view taken along the line XVI-XVI in FIG. 15.
Figure 17:
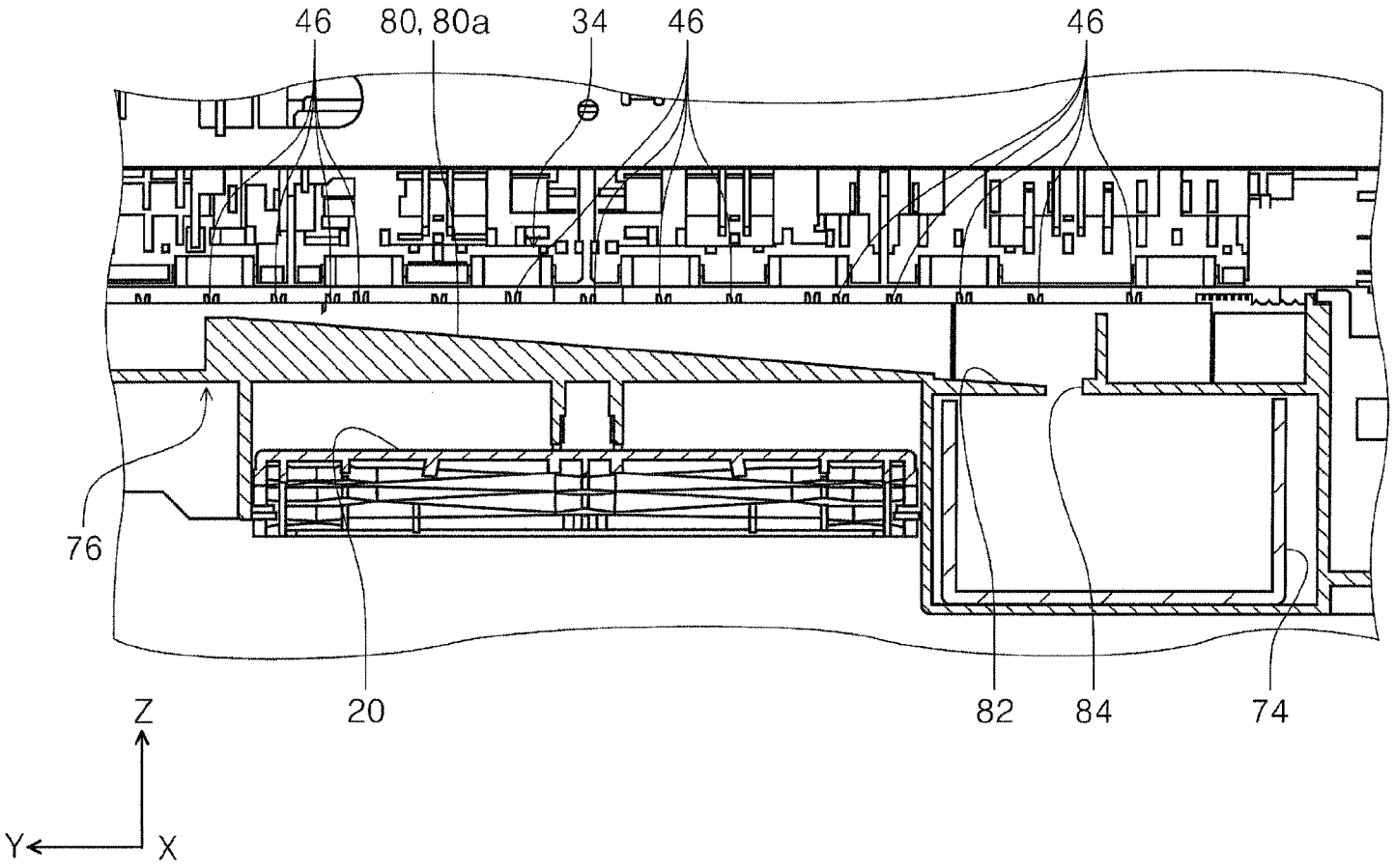
FIG. 17 is a cross-sectional view taken along the line XVII-XVII in FIG. 15.
Figure 18:
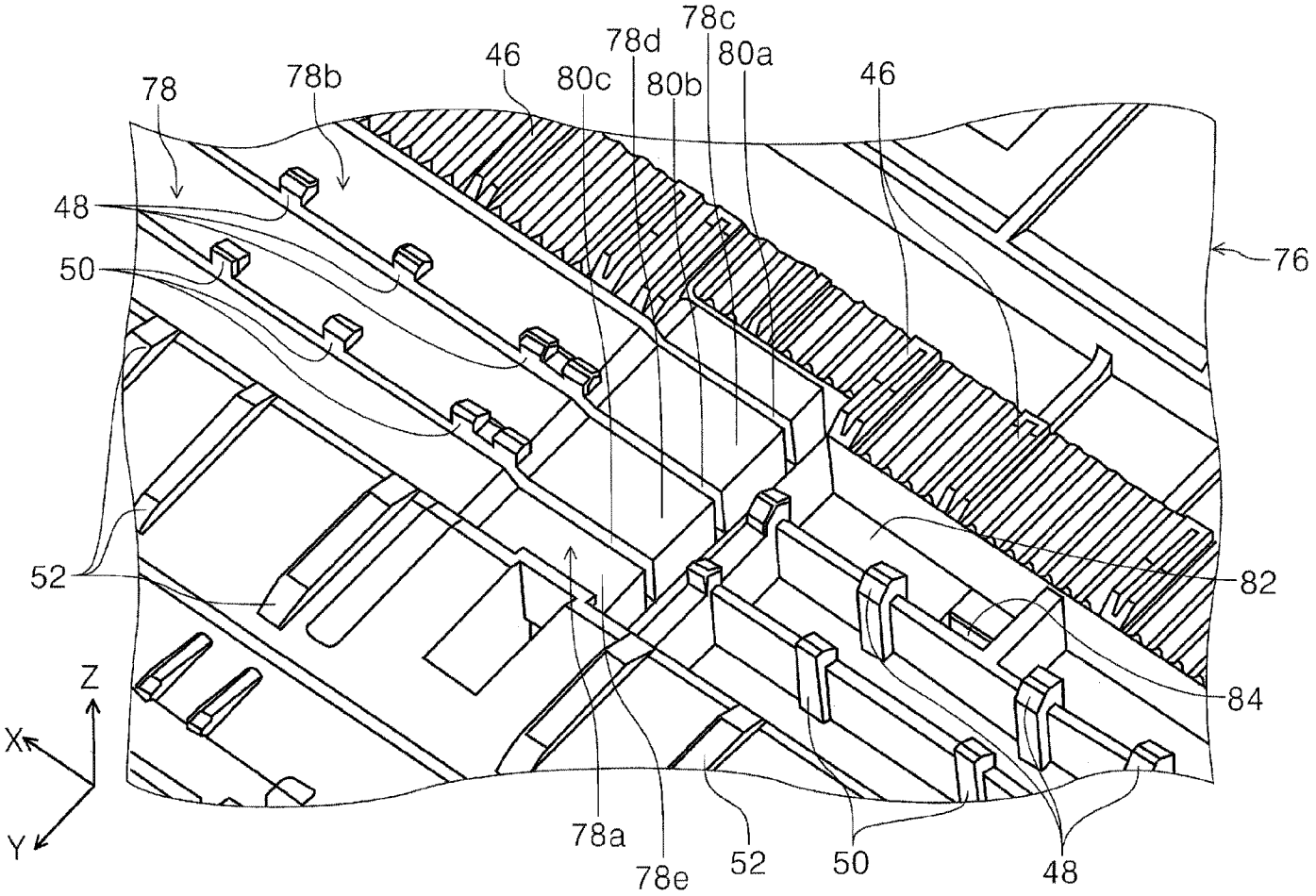
FIG. 18 is a perspective view illustrating a guide path which guides the liquid to the waste liquid accommodation container in the support member.
Figure 19:
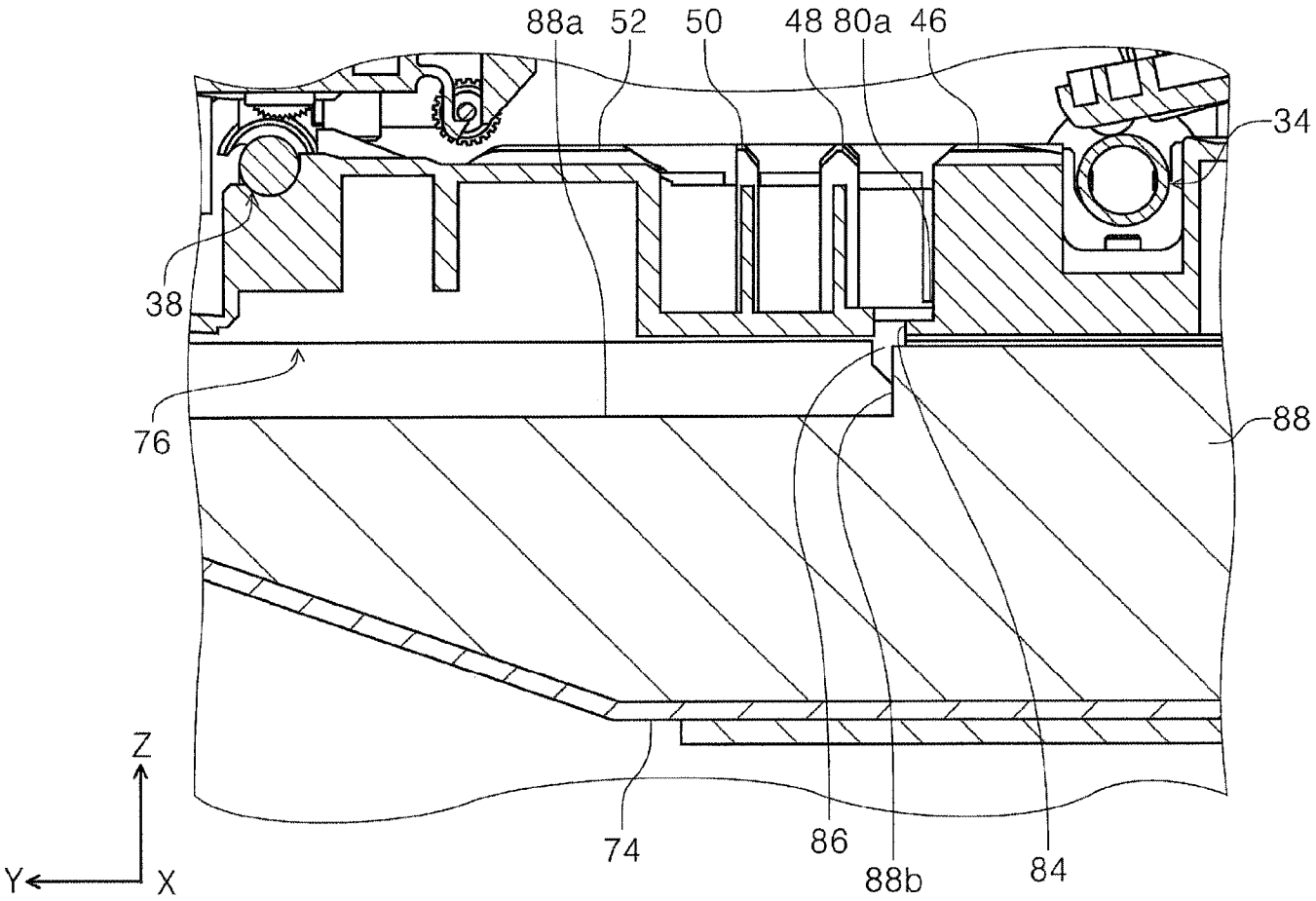
FIG. 19 is a cross-sectional view illustrating a relationship between the support member and the waste liquid accommodation container.

FIG. 15 is a perspective view illustrating a support member according to a third embodiment, FIG. 16 is a cross-sectional view taken along the line XVI-XVI in FIG. 15, FIG. 17 is a cross-sectional view taken along the line XVII-XVII in FIG. 15, FIG. 18 is a perspective view illustrating a guide path which guides the liquid to the waste liquid accommodation container in the support member, FIG. 19 is a cross-sectional view illustrating a relationship between the support member and the waste liquid accommodation container.

Figure 20:
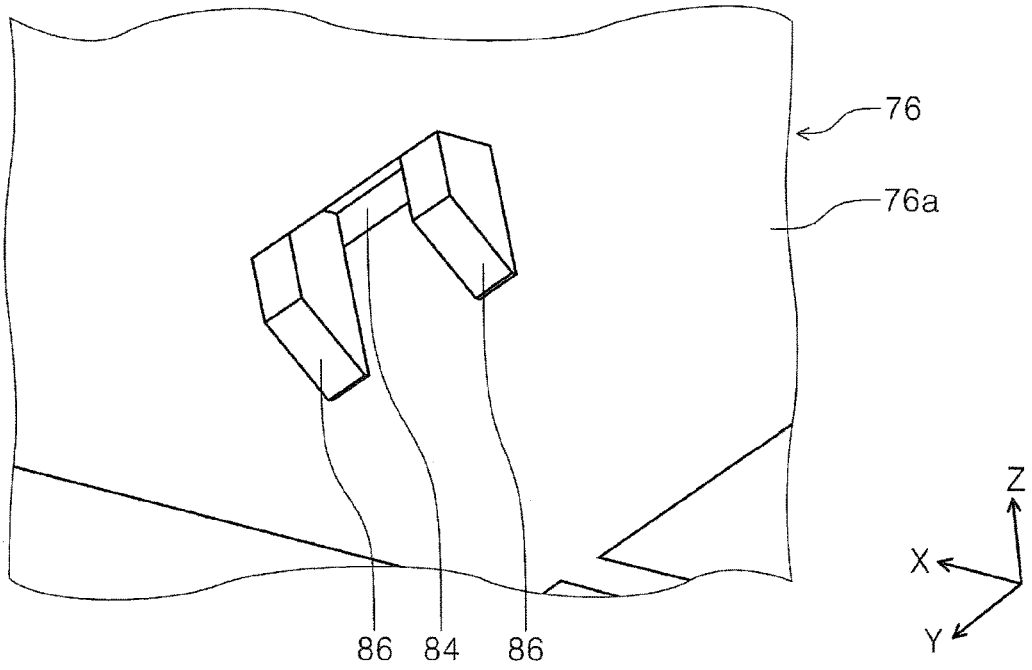
FIG. 20 is a perspective view illustrating an engagement portion of the support member with the waste liquid accommodation container.
Figure 21:
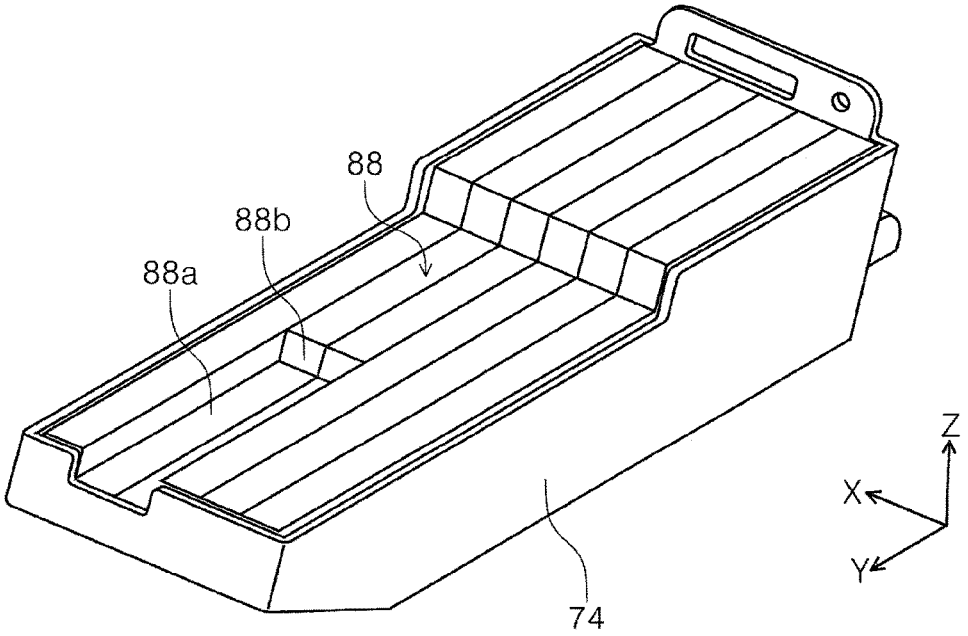
FIG. 21 is a perspective view illustrating the waste liquid accommodation container.
Figure 22:
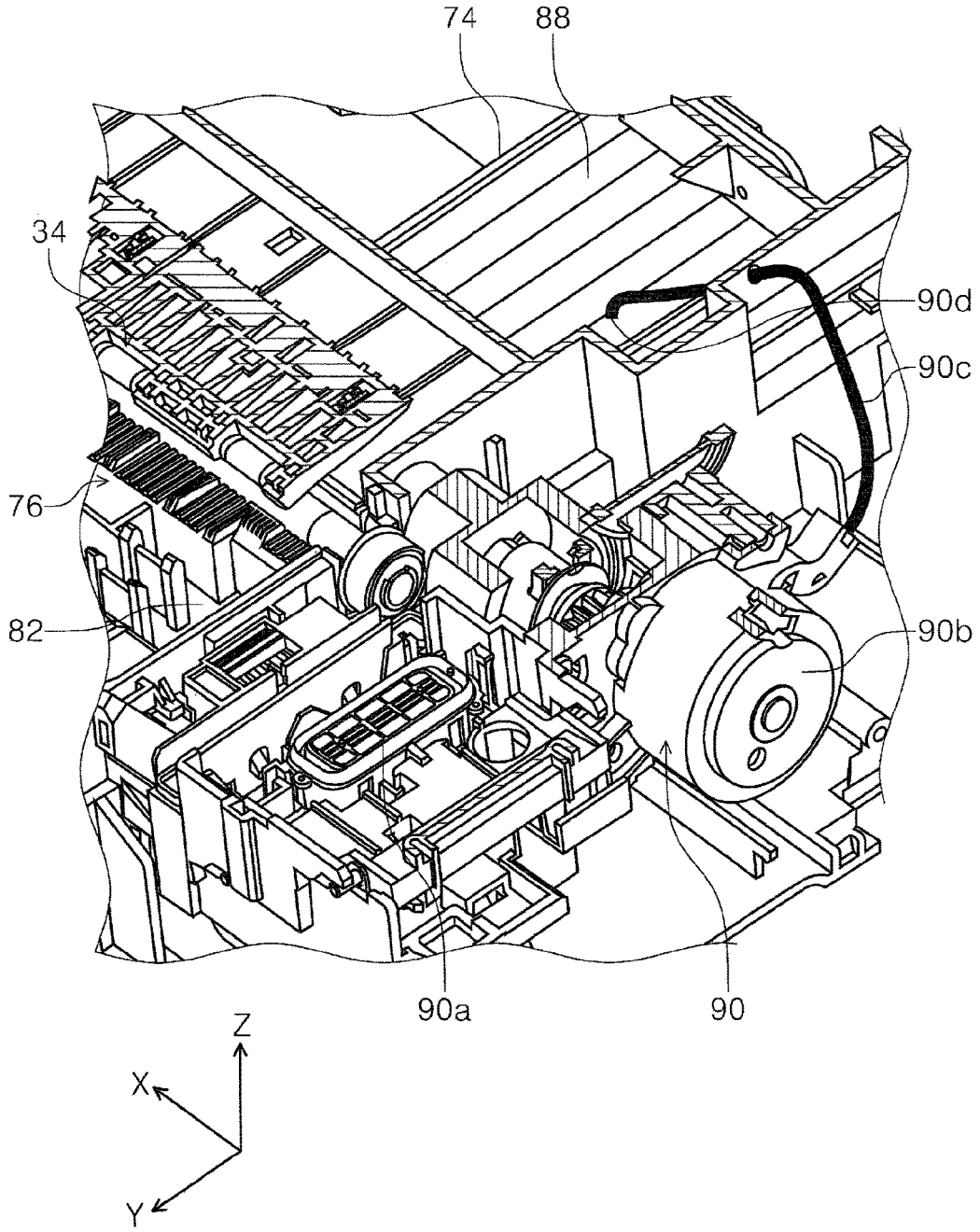
FIG. 22 is a perspective view illustrating a modification example of the third embodiment.
Figure 23:
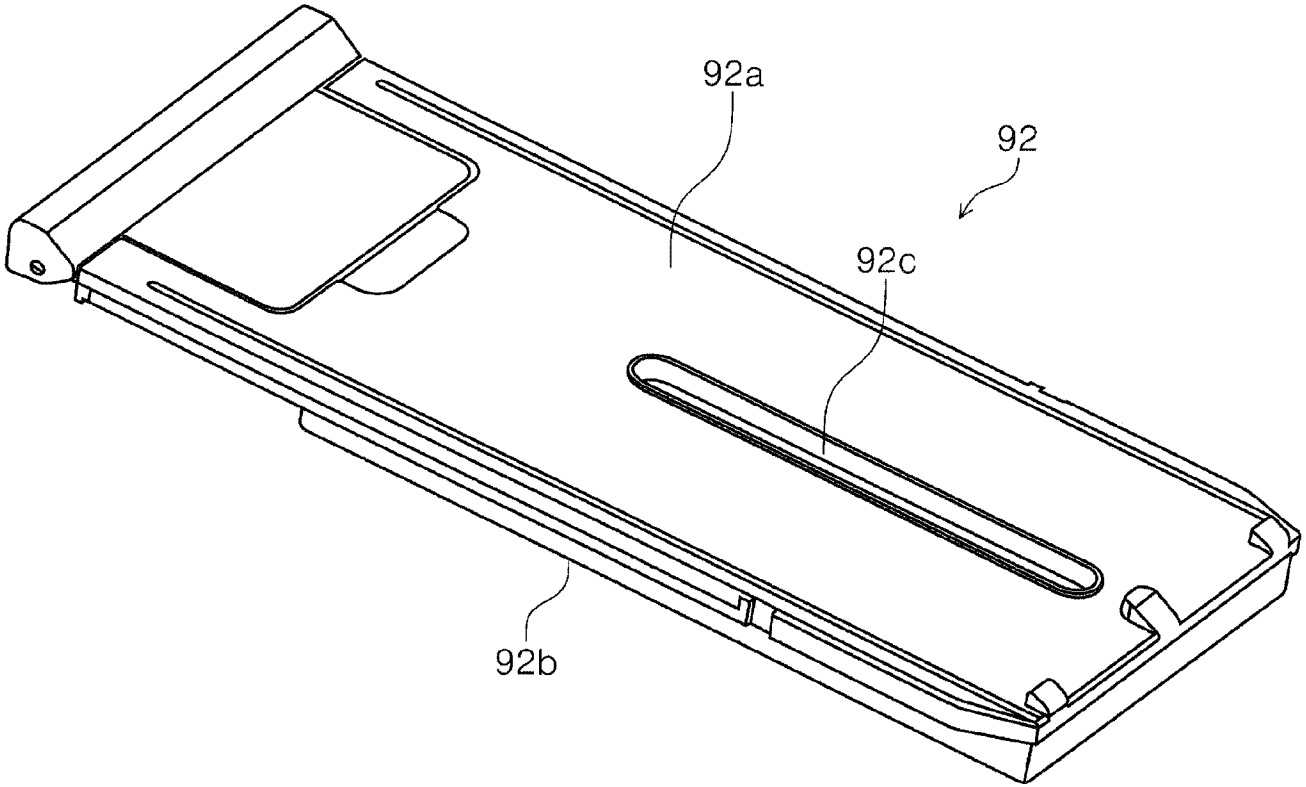
FIG. 23 is a perspective view illustrating a medium receiving tray according to a fourth embodiment.

FIG. 20 is a perspective view illustrating an engagement portion of the support member with the waste liquid accommodation container, FIG. 21 is a perspective view illustrating the waste liquid accommodation container, FIG. 22 is a perspective view illustrating a modification example of the third embodiment, and FIG. 23 is a perspective view illustrating a medium receiving tray according to a fourth embodiment.

Figure 24:
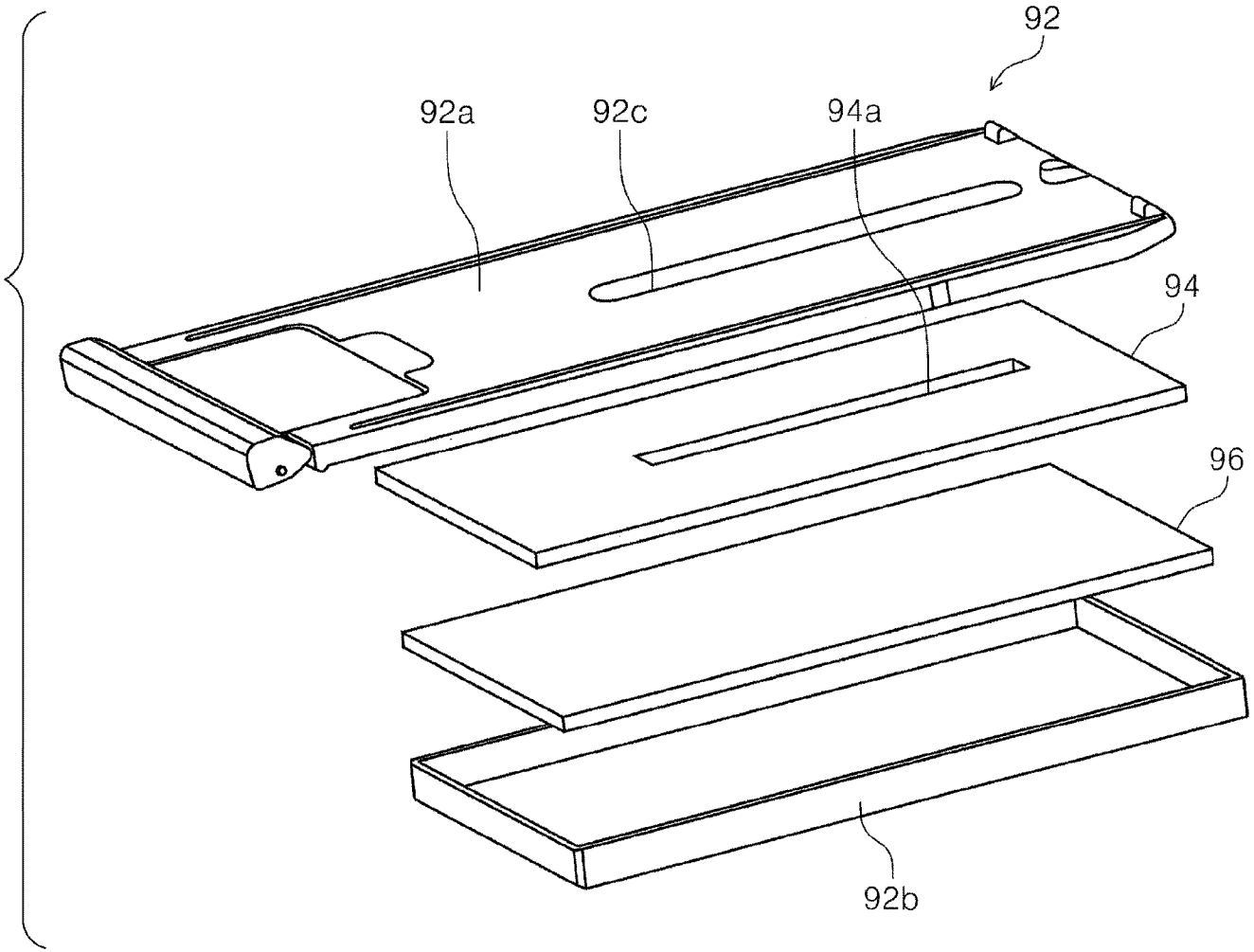
FIG. 24 is an exploded perspective view illustrating the medium receiving tray according to the fourth embodiment.
Figure 25:
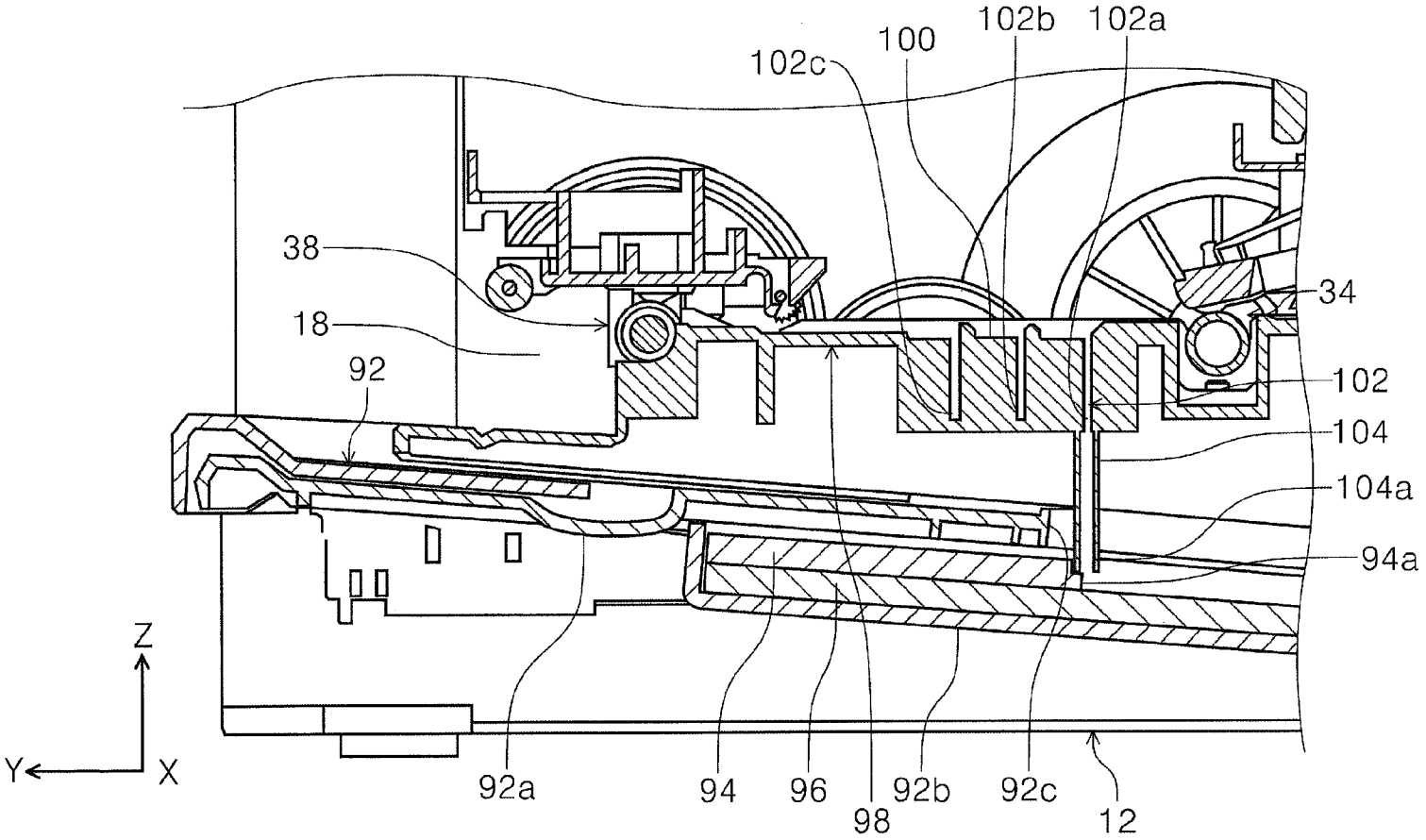
FIG. 25 is a side cross-sectional view illustrating a storage state of the medium receiving tray according to the fourth embodiment.
Figure 26:
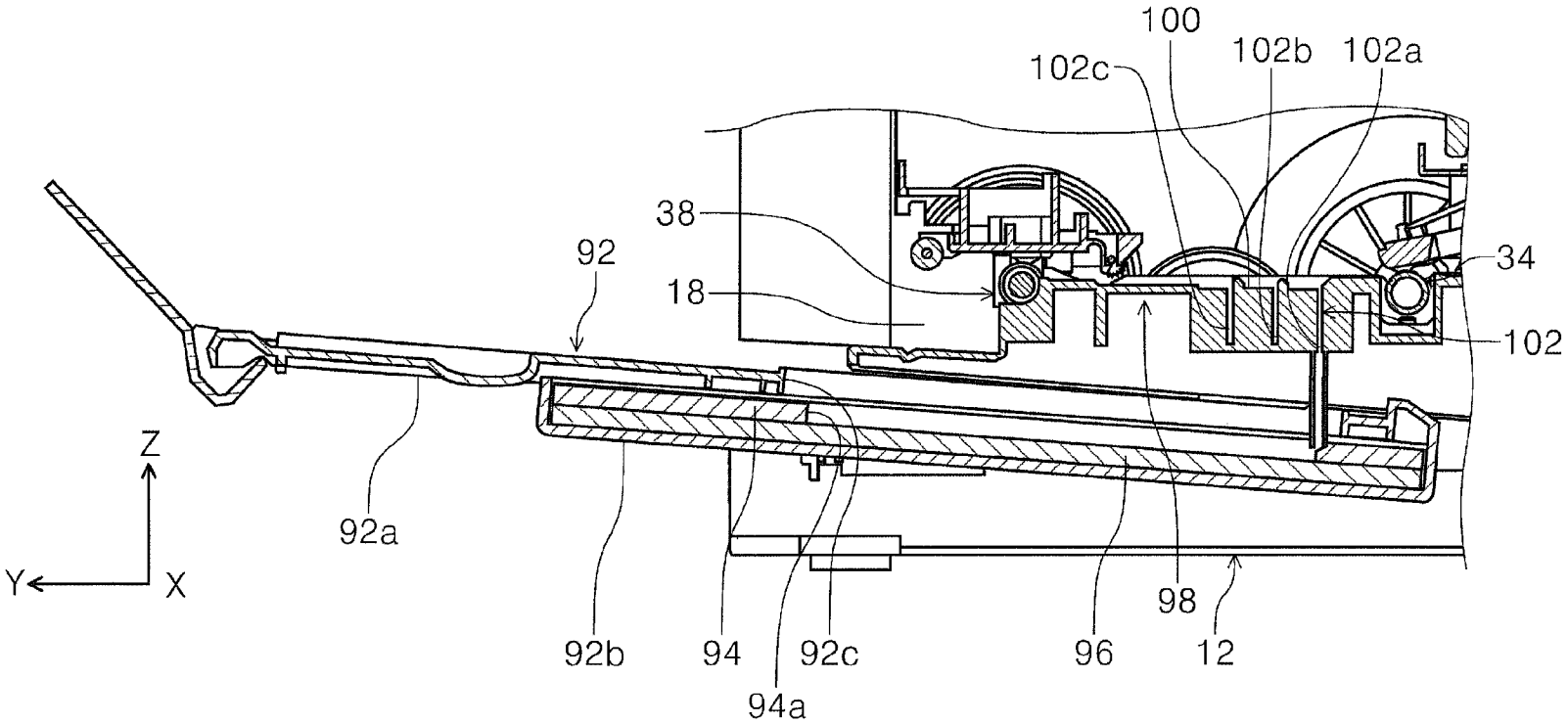
FIG. 26 is a side cross-sectional view illustrating a developed state of the medium receiving tray according to the fourth embodiment.

FIG. 24 is an exploded perspective view illustrating the medium receiving tray according to a fourth embodiment, FIG. 25 is a side cross-sectional view illustrating a storage state of the medium receiving tray according to the fourth embodiment, and FIG. 26 is a side cross-sectional view illustrating a developed state of the medium receiving tray according to the fourth embodiment.

In addition, in the X-Y-Z coordinate system illustrated in each drawing, a X-direction indicates a width direction of a recording medium, that is, an apparatus width direction, a Y-direction indicates a transport direction of the recording medium in a transport path in the recording apparatus, that is, an apparatus depth direction, and a Z-direction indicates an apparatus height direction.

First Embodiment

Overview of Printer

With reference to FIGS. 1 and 2, the overall configuration of a printer 10 will be described. The printer 10 is configured as an ink jet printer as an example of a recording apparatus. The printer 10 is configured as a multifunction peripheral including an apparatus main body 12 and a scanner unit 14. An operation unit 16 is provided on an apparatus front side of the apparatus main body 12.

A discharge port 18 is formed on the front side of the apparatus main body 12. The discharge port 18 is provided with a medium receiving tray 20. The medium receiving tray 20 is configured to be capable of switching between a stored state (two-dot chain line portion in FIGS. 1 and 2) and a deployed state (FIG. 2) with respect to the apparatus main body 12. In FIG. 3, reference numeral 20-1 denotes the medium receiving tray in the stored state.

A medium support tray 22 is provided on a rear surface of the apparatus main body 12. The medium support tray 22 is also configured to be capable of switching between a stored state (FIG. 1) and a deployed state (FIG. 2) with respect to the apparatus main body 12. By setting the medium on the medium support tray 22 in the deployed state, the medium can be supplied into the apparatus main body 12.

The scanner unit 14 is disposed above the apparatus main body 12. On the upper portion of the scanner unit 14, the cover 24 is attached so as to be rotatable about a −Y-axis direction side end portion as a rotation point. In this embodiment, the cover 24 is configured to be capable of switching between a closed posture (FIG. 1) in which the cover is provided on the upper portion of the scanner unit 14, covers a document table 26 (FIG. 3) on which a document can be set, and configures a portion of the upper surface of the printer 10, and an opened posture (not illustrated) in which the cover rotates toward the −Y direction side to expose the document table 26.

About Medium Transport Path

In FIG. 3, the medium transport path 28 will be described. In FIG. 3, the medium support tray 22 is pulled out from the apparatus main body 12 in a state of being inclined toward the −Y direction side. The medium support tray 22 supports the medium in a posture inclined toward the −Y direction side. The medium in this embodiment includes media of different sizes such as paper, photographic paper, postcard, having A4 size and B5 size, as an example.

In the apparatus main body 12, a feeding roller 30, a separation roller 32, a transport roller pair 34, a recording unit 36, and a discharge roller pair 38 are provided in this order along the medium transport path 28. In FIG. 3, a thick solid line denoted by reference symbol P indicates a guiding path of the medium transported along the medium transport path 28 from the medium support tray 22 to the medium receiving tray 20, and in FIG. 6, a thick solid line denoted by reference symbol P indicates the guide path of the medium from the transport roller pair 34 to the discharge roller pair 38. The medium set in the medium support tray 22 is nipped by the feeding roller 30 and the separation roller 32 and is sent toward the transport roller pair 34. The transport roller pair 34 transports the medium P to the recording unit 36.

The recording unit 36 includes a carriage 40, a recording head 42 as a "liquid emitting head", and a support member 44. The carriage 40 is configured to be capable of reciprocating in the apparatus width direction. The recording head 42 is provided under the carriage 40. On the lower surface of the recording head 42, a plurality of ink emitting nozzles capable of emitting ink as "liquid" in the −Z-axis direction are provided.

Under the recording head 42, a support member 44 is provided in a region facing the recording head 42. The support member 44 faces the recording head 42 and defines the distance from the recording head 42, that is, the gap. The support member 44 supports a lower surface (surface opposite to recording surface) of the medium P transported to a region facing the recording head 42 by the transport roller pair 34. Then, the recording head 42 emits liquid (ink) on the medium P supported by the support member 44, and executes recording on the recording surface of the medium P. The medium P on which recording has been performed is nipped by a discharge roller pair 38 provided on the downstream side of the recording unit 36 in the transport direction and discharged toward the medium receiving tray 20.

About Configuration of Support Member

In FIGS. 4 to 7, the configuration of the support member 44 will be described. In FIG. 4, the support member 44 extends in the X-axis direction. On the upper surface of the support member 44, a first rib group 46, a second rib group 48, a third rib group 50, and a fourth rib group 52 are provided at appropriate intervals from the −Y direction to the +Y direction. Each of the rib groups 46, 48, 50, and 52 has a plurality of ribs each protruding in the +Z direction from the upper surface of the support member 44, and the plurality of ribs are disposed at an appropriate interval in the X-axis direction. In FIG. 4, only some of the plurality of ribs constituting the first rib group 46, the second rib group 48, the third rib group 50, and the fourth rib group 52 are denoted by reference numerals.

As illustrated in FIG. 6, the positions of the upper surfaces of each of the ribs of the first rib group 46, the second rib group 48, the third rib group 50, and the fourth rib group 52 in the Z-axis direction are set to the same height. Accordingly, each of ribs of the first rib group 46, the second rib group 48, the third rib group 50, and the fourth rib group 52 supports so that a medium P transported to the recording unit 36 keeps the medium P at a predetermined distance with respect to the recording head 42.

Here, the two-dot chain line denoted by reference numeral P1 in FIG. 4 indicates an occupation region of the first medium P1 in the medium transport path 28 at some point of time. In this embodiment, the first medium is set as a photographic paper, postcard, paper of a size such as 4×6. The two-dot chain line denoted by reference numeral P2 indicates an occupation region of the second medium P2 in the medium transport path 28 at some point of time. In this embodiment, the second medium is set to paper having a size of 4×6 or more, for example, B5 size or A4 size.

In FIG. 4 and FIG. 5, in the upper surface of the support member 44 in this embodiment, the liquid receiving portion 54 is formed at a center portion in the X-axis direction, and the absorbing material disposing portion 56 is formed on both sides of the liquid receiving portion 54 in the X-axis direction.

In FIGS. 2 and 5, the medium receiving tray 20 is positioned on the −Z direction side of the support member 44 in the storage state and the deployed state. Specifically, as illustrated in FIG. 2, the −Y direction side (upstream side in transport direction) of the medium receiving tray 20 is positioned on the −Z direction side of the support member 44.

About Liquid Receiving Portion

In this embodiment, the liquid receiving portion 54 is formed to hook to first regions W1 as regions through which the side end edge P1E of the first medium P1 in the X-axis direction passes and a third region W3 that is positioned between the two first regions W1. Specifically, the liquid receiving portion 54 includes a liquid receiving portion 54*a* corresponding to the first region W1 and a liquid receiving portion 54*b* corresponding to the third region W3. In this embodiment, as illustrated in FIG. 5, the liquid receiving portion 54*a* is formed so as to be positioned in the −Z direction in the Z-axis direction with respect to the liquid receiving portion 54*b*. In this embodiment, the first regions W1 are set to include the side end edge P1E in the X-axis direction on paper of photograph paper, postcard, paper having 4×6 size or the like, as the first medium P1 in the X-axis direction.

In this embodiment, the second region W2 is set outside the first region W1 in the X-axis direction. The second region W2 is set as a region through which the side end edge P2E in the X-axis direction of the second medium P2 passes. Specifically, the first region W1 is set to include the side end edge P2E on the B5 or A4 size paper in the X-axis direction as the second medium P2 in the X-axis direction.

In this embodiment, the absorbing material disposing portion 56 is formed so as to include the second region W2 in the X-axis direction. In this embodiment, the absorbing material disposing portion 56 is formed as a recessed portion in which the +Z direction side is opened in the support member 44. An ink absorbing materials 58 (FIGS. 4 and 5) as a plurality of "liquid absorbing materials" are stacked and disposed in the Z-axis direction in the recessed absorbing material disposing portion 56. In this embodiment, the ink absorbing material 58 is disposed in the absorbing material disposing portion 56 so as to be capable of being exposed from the +Z direction side of the support member 44.

In FIGS. 4 to 6, a plurality of grooves 60 extending in the X-axis direction is provided as an example of "guide means" in the liquid receiving portions 54*a* and 54*b*. The plurality of grooves 60 are disposed side by side at appropriate intervals in the Y-axis direction. In this embodiment, the groove 60 extends so as to communicate with the absorbing material disposing portion 56 disposed on both sides of the liquid receiving portion 54 in the X-axis direction.

In FIG. 6, the liquid receiving portion 54 of the support member 44 is formed to be lower in the Z-axis direction than the upper surface 44*a* of a portion where the first rib group 46 is formed and the upper surface 44*b* of a portion where the fourth rib group 52 is formed, in the support member 44. In FIG. 6, the two-dot chain line denoted by reference numeral Z1 indicates the height positions of the upper surface 44*a* and the upper surface 44*b* in the Z-axis direction.

In this embodiment, the plurality of grooves 60 are formed at least at a terminal end position of the first rib group 46, a starting end position and a terminal end position of the second rib group 48, a starting end position and a terminal end position of the third rib group 50, and a starting end position of the fourth rib group 52 in the Y-axis direction. A corner portion of the bottom portion of the groove 60 is formed in an edge shape. Further, as illustrated in FIG. 4, a communication groove 61 which connects the groove 60 provided at the starting position of the second rib group 48 and the groove 60 provided at the terminal end position is formed on both sides of each rib of the second rib group 48 in the X-axis direction. The same communication groove 61 is also formed in each rib of the third rib group 50. Accordingly, each of the ribs of the second rib group 48 and the third rib group 50 is surrounded by the groove 60 and the communication groove 61.

Referring again to FIG. 4, when marginless printing is performed on the side end edge P1E of the first medium P1 in the X-axis direction, ink is emitted from the side end edge P1E to a region outside the X-axis direction. This outer region, that is, a portion of the ink emitted into the first regions W1, adheres to the liquid receiving portion 54*a*. The ink received by the liquid receiving portion 54*a* enters a plurality of grooves 60 provided in the liquid receiving portion 54*a* and moves to the bottom portion of the groove 60. In this embodiment, since the corner portion of the bottom portion of the groove 60 is formed in an edge shape, the ink reaching the bottom portion spreads along the X-axis direction by the capillary phenomenon by the edge of the corner portion. As a result, the ink is absorbed by the ink absorbing members 58 positioned at both ends of the groove 60 in the X-axis direction.

In a case where marginless printing is performed on the first medium P1, when the recording head 42 emits ink to a front end or a rear end of the first medium P1, a portion of the ink to be emitted is emitted in a state of being deviated to the downstream side of the front end of the first medium P1 or the upstream side of the rear end of the first medium P1 in the Y-axis direction. In this case, a portion of the emitted ink adheres to a portion corresponding to the downstream side of the front end of the first medium P1 or the upstream side of the rear end in the liquid receiving portions 54*a* and 54*b*. In this embodiment, since the groove 60 is also formed in the liquid receiving portion 54*b* corresponding to the third region W3, even if the liquid receiving portion 54*b* receives the ink that protrudes from the front end and the rear end of the first medium P1, the groove 60 guides the ink to the ink absorbing material 58 through the liquid receiving portion 54*a*. As a result, the ink received by the liquid receiving portion 54*b* can also be reliably absorbed by the ink absorbing material 58.

In this embodiment, since the periphery of each of the ribs of the second rib group 48 and the third rib group 50 is surrounded by the groove 60 and the communication groove 61 and ink adhered to the base portions of the respective ribs projecting from the support member 44 is also guided toward the ink absorbing material 58 via the communication groove 61 or directly by the groove 60, it is possible to suppress the accumulation of ink at the base portion of each rib.

Furthermore, in this embodiment, a groove 60 (groove 60 provided at terminal end position of first rib group 46 and groove 60 provided at starting position of fourth rib group 52) is formed even on least one of the upstream side and the downstream side of the liquid receiving portion 54. Accordingly, outflow of the ink received by the liquid receiving portion 54 from the liquid receiving portion 54 in the Y-axis direction can be suppressed.

About Holding Member

In FIGS. 5 and 7, a tubular holding member attaching portion 56*a* protruding in the +Z axial direction is formed in the absorbing material disposing portion 56. As illustrated in FIG. 7, a fitted portion 56*b* and an engaged portion 56*c* are formed on the inner periphery of the holding member attaching portion 56*a*. In this embodiment, the holding member 62 is inserted into the tubular holding member attaching portion 56*a*. The holding member 62 includes a flange portion 62*a*, a fitting portion 62*b*, and a hook portion 62*c*.

The flange portion 62*a* is formed on the upper portion of the holding member 62. The size of the flange portion 62*a* in the radial direction is set to be larger than the size of the holding member attaching portion 56*a* in the radial direction. Accordingly, a portion of the flange portion 62*a* that protrudes from the holding member attaching portion 56*a* presses the ink absorbing material 58 from the +Z direction side to hold the ink absorbing material 58 in the absorbing material disposing portion 56.

In this embodiment, the fitted portion 56*b* formed on the upper portion of the holding member attaching portion 56*a* is set to have a dimension which is detachable and in which the fitting portion 62*b* is fitted to the fitted portion 56*b* within a range where no gap is formed between fitting portion 62*b* and the fitted portion 56*b*, when the holding member 62 is attached to the holding member attaching portion 56*a*. In this embodiment, since the fitting portion 62*b* is fitted to the fitted portion 56*b*, even if the ink absorbed by the ink absorbing material 58 travels between the holding member 62 and the holding member attaching portion 56*a*, it is possible to prevent intrusion of the holding member attaching portion 56*a* into the inner peripheral side by the fitting portion 62*b*. As a result, it is possible to prevent the ink leaked from the ink absorbing material 58 from leaking out under the support member 44.

In this embodiment, the hook portion 62*c* of the holding member 62 is formed as a snap fit as an example. In this embodiment, at least a pair of hook portions 62*c* is provided. In a state where the holding member 62 is attached to the holding member attaching portion 56*a*, the pair of hook portions 62*c* is engaged with the engaged portion 56*c* of the holding member attaching portion 56*a*. When the pair of hook portions 62*c* is displaced towards each other, an engagement state between the hook portion 62*c* and the engaged portion 56*c* is released, and the holding member 62 can be removed from the holding member attaching portion 56*a*.

In this embodiment, it is necessary to access from the lower side of the support member 44 for removal of the holding member 62, but it is also preferable that the holding member 62 can be detached by access from the upper side. In that case, for example, the holding member may be configured with a screw having a flange portion. In this case, the inner side of the holding member attaching portion 56*a* is configured with a screw hole.

Modification Example of First Embodiment (1) In this embodiment, as illustrated in FIG. 5, a region S1 is formed on the −Z direction side of the absorbing material disposing portion 56. In the absorbing material disposing portion 56 of this embodiment, the depth of the absorbing material disposing portion 56 in the Z-axis direction may increase in order to use this region S1. In a case where the absorbing material disposing portion 56 is disposed also in the region S1, the ink absorbing material 58 disposed in the absorbing material disposing portion 56 overlaps the medium receiving tray 20 in a range of the length L1 in the Z-axis direction. In addition, in a case of using the absorbing material disposing portion 56 by using the region S1, the volume of the ink absorbing material 58 disposed in the absorbing material disposing portion 56 may be changed according to the assumed amount of the waste liquid.

(2) In this embodiment, as illustrated in FIG. 6, the liquid receiving portion 54 is configured to be positioned lower than the upper surfaces 44*a* and 44*b* of the support member 44 in the Z-axis direction. However, since the grooves 60 are provided at the terminal end position of the first rib group 46 and the starting end position of the fourth rib group 52 in the Y-axis direction and it is possible to suppress the outflow of ink to the upstream side and the downstream side of the liquid receiving portion 54, the height position of the liquid receiving portion 54 in the Z-axis direction may be raised to a height Z1 as a height position of the upper surfaces 44*a* and 44*b* of the support member 44. Accordingly, since the distance between the liquid receiving portion 54 and the recording head 42 in the Z-axis direction is shortened, the ink emitted from the recording head 42 can further adhere, and occurrence of ink mist can be suppressed.

Second Embodiment

Next, in FIGS. 8 to 13, the support member 64 in the second embodiment will be described. In this embodiment, the configuration of the liquid receiving portion 66 provided in the support member 64 is different from that in the first embodiment. Specifically, the liquid receiving portion 66 is different from the first embodiment in that the groove 60 is not provided and a plurality of protrusion portions are provided on the surface. The other configuration is the same as that of the first embodiment. In FIG. 8, a two-dot chain line denoted by reference numeral P1 indicates an occupation region of the first medium P1 in the medium transport path 28 at some point of time, and a two-dot chain line denoted by reference numeral P2 indicates an occupation region of the second medium P2 at some point of time.

In this embodiment, the support member 64 includes a liquid receiving portion 66 and an absorbing material disposing portion 56 disposed on both sides of the liquid receiving portion 66 in the X-axis direction. The liquid receiving portion 66 includes a liquid receiving portion 66*a* corresponding to the first region W1 (FIGS. 4 and 5) and a liquid receiving portion 66*b* corresponding to the third region W3 (FIGS. 4 and 5). A plurality of protrusion portions are formed on the surfaces of the liquid receiving portions 66*a* and 66*b* as an example of "guide means". As an example, the plurality of protrusion portions are formed in a dot shape and are arranged over the entire upper surface of the liquid receiving portions 66*a* and 66*b* at a proper interval therebetween. In this embodiment, the support member 64 is formed of a resin material, and a plurality of dot-shaped protrusion shapes are formed by embossing processing with a metal mold.

The protrusion portion in this embodiment is configured such that, when ink is dropped, the ink spreads evenly around the protrusion portion. Therefore, the ink received by the liquid receiving portion 66 spreads along a plurality of protrusion portions provided in the liquid receiving portion 66 and is guided to the ink absorbing material 58 of the absorbing material disposing portion 56.

In FIG. 9, in the liquid receiving portion 66 in this embodiment, grooves 60 are formed at the terminal end position of the first rib group 46 and the starting end position of the fourth rib group 52 in the Y-axis direction. The groove 60 communicates with the absorbing material disposing portion 56 disposed on both sides of the liquid receiving portion 66 as in the first embodiment. This makes it possible to suppress or reduce the outflow of ink to the upstream side and the downstream side of the liquid receiving portion 66 even when the printer 10 is inclined in a state where the liquid receiving portion 66 receives the ink. In FIG. 9, a thick solid line denoted by reference numeral P indicates a guide path of the medium from the transport roller pair 34 to the discharge roller pair 38.

In this embodiment, since the ink received by the liquid receiving portion 66 spreads thinly on the surface of the liquid receiving portion 66 by the plurality of projection portions, drying of the ink proceeds quickly. As a result, the amount of ink absorbed by the ink absorbing material 58 can be reduced. Accordingly, since the ink absorbing capacity of the ink absorbing material 58 can be reduced and the ink absorbing material 58 can be made smaller, the absorbing material disposing portion 56 can be made smaller and the device can be downsized. In this embodiment, in a configuration in which a plurality of protrusion portions are formed in the liquid receiving portion 66, there is a case where the liquid receiving portion 66 is too clean, the ink may not spread. Therefore, it is desirable to contaminate the liquid receiving portion 66 with ink in advance, whereby the ink can be spread more reliably in the liquid receiving portion 66, and the guidance from the liquid receiving portion 66 to the ink absorbing material 58 can increase.

In this embodiment, since the liquid receiving portion 66 of the support member 64 is accurately formed by the metal mold, it is possible to stabilize the distance between the recording head 42 and the liquid receiving portion 66, so that occurrence of the contamination of the medium P, jam of the medium P and ink mist can be reduced. In addition, since the support member 64 is formed by metal mold molding, it is possible to reduce variations in the distance between the recording head 42 and the liquid receiving portion 66 for each machine body.

Since the plurality of protrusion portions of the liquid receiving portion 66 are performed by embossing processing with a metal mold, the structure of the metal mold can be simplified. Furthermore, since the dimensions and shape to be managed and measured as components can be simplified, cost reduction can be achieved.

Modification Example of Second Embodiment (1) In this embodiment, the ink absorbing material 58 is disposed in the absorbing material disposing portion 56, but, instead of this configuration, as illustrated in FIG. 10, the ink absorbing material 58 is not disposed on the absorbing material disposing portion 68, a plurality of dot-shaped protrusion portions may be disposed in the absorbing material disposing portion 68 as in a case of the liquid receiving portion 66, and as illustrated in FIG. 11, the plurality of grooves 60 which extend to the absorbing material disposing portion 70 in the X-axis direction may be disposed side by side along the Y-axis direction, or a plurality of recessed portions (not illustrated) may be provided instead of the groove 60.

(2) In this embodiment, the end portion of the liquid receiving portion 66*a* on a side of the absorbing material disposing portion 70 is formed as a flat surface (FIGS. 10 and 11) along the Y-axis direction, but instead of this configuration, a plurality of grooves 72 extending in the Z-axis direction may be disposed side by side in the Y-axis direction on the end portion of the liquid receiving portion 66*a* on the side of the absorbing material disposing portion 70 as illustrated in FIG. 12.

(3) In this embodiment, the upper portion 66*c* of the end portion of the liquid receiving portion 66*a* on the side of the absorbing material disposing portion 70 is formed in an R shape (portion indicated by reference numeral 66*c* in FIGS. 10 and 11), but instead of this configuration, it may be formed in a C-plane shape as illustrated in FIG. 13.

(4) In this embodiment, the liquid receiving portions 66*a* and 66*b* are configured as flat surfaces along the X-axis direction, but instead of this configuration, the liquid receiving portions 66*a* and 66*b* may be configured as an inclined surface that descends in the −Z direction with the liquid receiving portions 66*a* and 66*b* facing the absorbing material disposing portion 56 side in the X-axis direction.

When the descriptions in the first embodiment and the second embodiment are summarized, the printer 10 includes a recording head 42 which emits ink on the medium P, and a support member 44 and 64 which are disposed facing the recording head 42 and supports the medium P, in the support members 44 and 64, in the first region W1 as a region through which the side end edge P1E of the first medium P1 in the X-axis direction passes, a liquid receiving portion 54*a* and 66*a* that receives the ink emitted on a region deviated from the side end edge P1E of the first medium P1 in the X-axis direction is provided, and in the second region W2 as a region through which the side end edge P2E of a second medium P2, in the X-axis direction, in which a size thereof in the X-axis direction is larger than that of the first medium P1 passes, the absorbing material disposing portion 56 that disposes an ink absorbing material 58 absorbing the ink guided from the liquid receiving portions 54*a* and 66*a* to be capable of being exposed from above the support members 44 and 64 is provided.

According to the above configuration, since, in the support members 44 and 64, in first members W1 as a region through which the side end edge P1E of the first medium P1 in the X-axis direction passes, a liquid receiving portion 54*a* and 66*a* that receives the ink emitted on a region deviated from the side end edge P1E of the first medium P1 in the X-axis direction is provided, and in the second region W2 as a region through which the side end edge P2E of a second medium P2, in the X-axis direction, in which a size thereof in the X-axis direction is larger than that of the first medium P1 passes, the absorbing material disposing portion 56 that disposes an ink absorbing material 58 absorbing the ink guided from the liquid receiving portions 54*a* and 66*a* to be capable of being exposed from above the support members 44 and 64 is provided, it is possible to secure a volume of the ink absorbing material 58 as compared with a configuration in which the absorbing material disposing portion 56 is provided on the −Y-axis direction side or the +Y-axis direction side with respect to the liquid receiving portions 54*a* and 66*a*. Moreover, since the ink absorbing material 58 is disposed at a position where the liquid absorbing material can be exposed from above the support members 44 and 64, exchangeability is also good.

In the first embodiment and the second embodiment, the absorbing material disposing portion 56 is provided on both sides of the liquid receiving portions 54*a* and 66*a* in the X-axis direction.

the liquid receiving portions 54*a* and 66*a* may be provided corresponding to the side end edge P1E on both sides of the first medium P1 in the X-axis direction, and a third region W3 as a region between the two liquid receiving portions 54*a* and 66*a* in the X-axis direction is configured as a liquid receiving portions 54*b* and 66*b* which receive the ink emitted in a region deviated from the edge (front end and rear end) of the first medium P1 in the Y-axis direction. According to this configuration, marginless recording can be performed on the edges (front end and rear end) of the first medium P1 in the Y-axis direction using the third region W3.

In the first embodiment and the second embodiment, the support members 44 and 64 are provided with grooves 60, communication grooves 61, or protrusion portions for guiding ink from the liquid receiving portions 54 and 66 to the absorbing material disposing portion 56. According to this configuration, it is possible to suppress the retention of the ink in the liquid receiving portions 54 and 66.

In the first embodiment and the second embodiment, the recording apparatus further comprises a medium receiving tray 20 for receiving the emitted medium after recording, and the −Y direction side of the medium receiving tray 20 in the Y-axis direction is positioned under the support members 44 and 64, and the absorbing material disposing portion 56 overlaps the medium receiving tray 20 in a range of the length L1 in the apparatus height direction. According to this configuration, the lateral region of the medium receiving tray 20 in the X-axis direction is used as the absorbing material disposing portion 56, and as a result, the absorbing material disposing portion 56 can be secured to be large, and the ink absorbing capability can be greatly improved.

In the first embodiment and the second embodiment, the ink absorbing material 58 disposed in the absorbing material disposing portion 56 is held by the holding member 62 having the flange portion 62*a*. According to this configuration, the ink absorbing material 58 can be securely held with a simple structure.

In the first embodiment and second embodiment, grooves 60 extending in the X-axis direction are provided on at least one of the upstream side and the downstream side in the Y-axis direction in the liquid receiving portions 54 and 66. According to this configuration, it is possible to prevent or suppress the outflow of ink (outflow in Y-axis direction) from the liquid receiving portions 54 and 66 when the printer 10 is inclined.

Third Embodiment

A third embodiment will be described with reference to FIGS. 14 to 22. In the upper and lower views of FIG. 14, a waste liquid accommodation container 74 is provided on the −X direction side of the medium receiving tray 20 on the back side of the apparatus main body 12. The waste liquid accommodation container 74 is detachably attached to the apparatus main body 12 from the back side of the apparatus main body 12.

In FIG. 15, the support member 76 in this embodiment is provided with a liquid receiving portion 78. Also in this embodiment, the liquid receiving portion 78 includes a liquid receiving portion 78*a* corresponding to the first region W1 and a liquid receiving portion 78*b* corresponding to the third region W3. Also in this embodiment, the support member 76 is provided with a first rib group 46, a second rib group 48, a third rib group 50, and a fourth rib group 52.

In this embodiment, a groove 80 as an example of the "guide means" is formed at the terminal end position of the first rib group 46, the terminal end position of the second rib group 48, the terminal end position of the third rib group 50, and the starting end position of the fourth rib group 52 along the Y-axis direction. Specifically, a groove 80*a* is formed at the terminal end position of the first rib group 46, a groove 80*b* is formed at the terminal position of the second rib group 48, and a groove 80*c* is formed at the terminal position of the third rib group 50.

As illustrated in FIG. 17, the groove 80 extends from the liquid receiving portion 78*a* on the +X direction side through the liquid receiving portion 78*b* to the liquid receiving portion 78*a* on the −X direction side. Further, the groove 80 is inclined so as to descend from the liquid receiving portion 78*a* on the +X direction side toward the liquid receiving portion 78*a* on the −X direction side.

Next, in FIG. 16, the region 78*c* between the groove 80*a* and the groove 80*b* of the liquid receiving portion 78 in the Y-axis direction, the region 78*d* between the groove 80*b* and the groove 80*c*, and the region 78*e* between the groove 80*c* and the starting end position of the fourth rib group 52 are configured as an inclined surface having a descending inclination that descends in the −Z direction toward the −Y direction side, respectively. The regions 78*c*, 78*d*, and 78*e* of the liquid receiving portion 78 in this embodiment are an example of "guide means".

In FIG. 18, a waste liquid guide path 82 is formed on the −X direction side of the liquid receiving portion 78*a* on the −X direction side of the support member 76. As illustrated in FIG. 17, the waste liquid guide path 82 is formed in a descending inclination that descends in the −Z direction toward the −X direction side. A through-hole 84 penetrating the support member 76 is formed at the −X direction side end portion of the waste liquid guide path 82. As illustrated in FIG. 20, on the bottom surface 76*a* of the support member 76, engagement portions 86 are provided on both sides of the through-hole 84 in the X-axis direction. The engagement portion 86 protrudes in the −Z direction from the bottom surface 76*a* of the support member 76.

Here, in FIG. 21, the waste liquid accommodation container 74 will be described. The waste liquid accommodation container 74 is formed in a box shape having an opening in the +Z direction side, and an ink absorbing material 88 is attached inside the waste liquid accommodation container 74. A groove 88*a* is provided in an upper portion of the ink absorbing material 88. An engaged portion 88*b* is provided at the terminal end on the −Y direction side of the groove 88*a*.

When the waste liquid accommodation container 74 is attached to the apparatus main body 12, the engagement portion 86 enters the groove 88*a*, and when the waste liquid accommodation container 74 is pushed to the attachment position with respect to the apparatus main body 12, as illustrated in FIG. 19, the engagement portion 86 engages with the engaged portion 88*b*, and the engagement portion 86 is in a state of pressing the engaged portion 88*b*.

In this embodiment, when the ink adheres to the liquid receiving portion 78, the ink is guided to the grooves 80*a*, 80*b*, and 80*c* by the descending inclination regions 78*c*, 78*d*, and 78*e*. The ink that has entered the grooves 80*a*, 80*b*, and 80*c* is guided to the waste liquid guide path 82 by the descending inclination grooves 80*a*, 80*b*, and 80*c* in the −X direction. The ink guided to the waste liquid guide path 82 enters the through-hole 84 and travels along the engagement portion 86 and is absorbed by the ink absorbing material 88 of the waste liquid accommodation container 74.

In this embodiment, the waste liquid accommodation container 74 is configured to be capable of accommodating not only waste ink from the liquid receiving portion 78 but also waste ink from a maintenance section 90. In FIG. 22, the maintenance section 90 for performing a maintenance operation of the recording head 42 of the carriage 40 is provided at the end portion on the −X direction side of the support member 76 in the apparatus main body 12. The maintenance section 90 includes a cap 90*a*, a pump 90*b*, and a waste ink tube 90*c*.

The maintenance operation in the maintenance section 90 in this embodiment is a suction operation for sucking ink remaining in the ink emitting nozzle of the recording head 42 when the carriage 40 is positioned at the home position, a capping operation for moisturizing the recording head 42 by covering the recording head 42 with the cap 90*a*, and a flushing operation for emitting the ink from the recording head 42 and discarding the ink to the cap 90*a* during the recording operation.

When the pump 90*b* is driven during the maintenance operation, the pump 90*b* sucks the ink in the cap 90*a* and feeds the waste ink sucked into the waste ink tube 90*c*. Here, as illustrated in FIG. 22, the waste ink tube 90*c* is routed inside the apparatus main body 12 so that the terminal end 90*d* of the waste ink tube 90*c* is positioned on the +Z direction side of the ink absorbing material 88 of the waste liquid accommodation container 74. Accordingly, the waste ink sucked by the pump 90*b* is absorbed by the ink absorbing material 88 via the waste ink tube 90*c*.

In this embodiment, since the ink discarded by the support member 76 and the waste ink recovered by the maintenance section 90 can be accommodated in one place, it is possible to reduce the number of components compared to a configuration in which separate waste ink accommodation portions are provided and the waste ink accommodation space of the maintenance section 90 can be effectively used for another configuration.

Modification Example of Third Embodiment (1) A plurality of dot-shaped protrusion portions in the second embodiment may be formed in the regions 78*c*, 78*d*, and 78*e* of the liquid receiving portion 78 in this embodiment. Accordingly, it is possible to more reliably guide the ink adhering to the regions 78*c*, 78*d*, and 78*e* to the grooves 80*a*, 80*b*, and 80*c*.

(2) In this embodiment, the waste liquid accommodation container 74 is disposed on the −X direction side of the medium receiving tray 20 in the X-axis direction, but, instead of this configuration, the waste liquid accommodation container 74 may be disposed on the +X direction side of the medium receiving tray 20.

Fourth Embodiment

In FIGS. 23 to 26, the fourth embodiment will be described. In FIGS. 23 and 24, the medium receiving tray 92 in this embodiment includes a tray portion 92*a* and an ink absorbing material accommodation portion 92*b*. A long hole 92*c* is provided in the tray portion 92*a*. The ink absorbing material accommodation portion 92*b* is formed in a box shape, and the side facing the tray portion 92*a* is opened. In this embodiment, ink absorbing materials 94 and 96 are accommodated in the ink absorbing material accommodation portion 92*b*. In this embodiment, an long hole 94*a* is formed in the ink absorbing material 94 at a position corresponding to the long hole 92*c* of the tray portion 92*a*.

The medium receiving tray 92 in this embodiment is detachably mounted from the front side of the apparatus main body 12. The medium receiving tray 92 in this embodiment is configured to be movable between a state of being accommodated in the apparatus main body 12 illustrated in FIG. 25 and a state of being drawn out from the apparatus main body 12 illustrated in FIG. 26 and developed in the +Y direction side. As an example, the medium receiving tray 92 assumes a posture inclined such that the end portion on the +Y direction side is positioned on the +Z direction side with respect to the −Y direction side end portion in both the accommodated state and the developed state. In this embodiment, as an example, the medium receiving tray 92 is configured to be movable in the Y-axis direction by a distance corresponding to the length of the long hole 92*c*.

In FIG. 25, a liquid receiving portion 100 is formed on the support member 98. A plurality of grooves 102 are formed in the liquid receiving portion 100. As an example, grooves 102*a*, 102*b*, and 102*c* are formed. In this embodiment, although not illustrated, the grooves 102*a*, 102*b*, and 102*c* are inclined from the X-axis direction outer side to the central portion in the X-axis direction, and the center portion of each groove in the X-axis direction is set to be the lowest in the Z-axis direction. In addition, although not illustrated, a communication groove is formed between the groove 102*a* and the groove 102*b* and between the groove 102*b* and the groove 102*c*, and the ink that has entered the groove 102*b* and the groove 102*c* is configured to be guided to the groove 102*a*.

An ink discharge portion 104 extending in the −Z direction is formed in the central portion of the groove 102*a* in the X-axis direction. As an example, the ink discharge portion 104 is formed in a tubular shape, and guides the ink that has entered the groove 102*a* toward the lower side of the support member 98.

The lower end portion of the ink discharge portion 104 is configured as an engagement portion 104*a*. At least a portion of the ink discharge portion 104 is inserted into the long hole 92*c* of the medium receiving tray 92.

As illustrated in FIG. 25, when the medium receiving tray 92 is in the accommodated state with respect to the apparatus main body 12, the engagement portion 104*a* of the ink discharge portion 104 inserted into the long hole 92*c* of the medium receiving tray 92 engages with the +Y direction side end portion of the long hole 94*a* of the ink absorbing material 94 in the medium receiving tray 92, and is pressed against the +Y direction side end portion. In this state, the ink that has passed through the ink discharge portion 104 from the groove 102*a* is absorbed by the ink absorbing material 94 in contact with the engagement portion 104*a*.

Next, as illustrated in FIG. 26, when the medium receiving tray 92 is moved to the +Y direction side with respect to the apparatus main body 12, the long hole 92*c* of the medium receiving tray 92 and the long hole 94*a* of the ink absorbing material 94 are moved to the +Y direction side with respect to the ink discharge portion 104.

Accordingly, the engagement portion 104*a* of the ink discharge portion 104 is positioned at the −Y direction side end portion of the long hole 92*c* and the long hole 94*a*. As a result, the engagement portion 104*a* of the ink discharge portion 104 is in a state of being engaged with the −Y direction side end portion of the long hole 94*a* of the ink absorbing material 94 in the medium receiving tray 92, and being pressed against the −Y direction side end portion. Even in this state, the ink that has passed through the ink discharge portion 104 from the groove 102*a* is absorbed by the ink absorbing material 94 in contact with the engagement portion 104*a*.

Modification Example of Fourth Embodiment

In this embodiment, the medium receiving tray 92 takes an inclined posture in which the +Y direction side end portion faces upward in both the accommodated state and the deployed state with respect to the apparatus main body 12, but instead of this configuration, in the accommodated state of the medium receiving tray 92, when the tray 92 is in the horizontal state along the Y-axis direction and switched from the accommodated state to the deployed state, the tray 92 may be in an inclined posture in which the +Y direction side end portion faces upward. In this configuration, when the medium receiving tray 92 is in the stored state, it is in a horizontal state along the Y-axis direction, so that the ink absorbed by the ink absorbing materials 94 and 96 is not biased toward the −Y direction side and the ink can be uniformly held at the ink absorbing material 94 and 96.

In addition, in each of the embodiments, the support members 44, 64, 76, and 98 according to the invention are applied to an ink jet printer as an example of a recording apparatus, but it is also possible to apply to other liquid ejecting apparatuses in general.

Here, the liquid ejecting apparatus is not limited to a recording apparatus such as a printer, a copying machine, a facsimile, or the like which uses an ink jet type recording head and records on a medium to be recorded by emitting ink from the recording head, and includes an apparatus which ejects a liquid corresponding to the application instead of ink from a liquid ejecting head corresponding to the ink jet type recording head on a medium to be ejected corresponding to a medium to be recorded and adheres the liquid to a medium to be ejected.

As a liquid ejecting head, in addition to the recording head, an electrode material (conductive paste) ejected head used for forming an electrode of a color material ejecting head used for manufacturing a color filter of a liquid crystal display or the like, an organic EL display, a field-emission display (FED), a bioorganic material ejecting head used for manufacturing a biochip, a sample ejecting head as a precision pipette, and the like.

The invention is not limited to the above-described embodiment, and various modifications are possible within the scope of the invention described in the claims, and various modifications are also included within the scope of the invention.

The entire disclosure of Japanese Patent Application No. 2017-187591, filed Sep. 28, 2017 is expressly incorporated by reference herein.

What is claimed is:

1. A recording apparatus comprising:

a liquid emitting head that emits a liquid on a medium; and a support member that is disposed to face the liquid emitting head and supports the medium, wherein, in the support member, in a first region as a region through which an edge of a first medium passes in a medium width direction as a direction intersecting a medium transport direction, a liquid receiving portion is provided which receives the liquid emitted on a region deviated from the edge of the first medium in the medium width direction, and wherein, in a second region as a region through which an edge of a second medium in which a size thereof in the medium width direction is larger than that of the first medium passes, an absorbing material disposing portion at which a liquid absorbing material which absorbs the liquid guided from the liquid receiving portion is disposed to be capable of being exposed from an upper side of the support member is provided.

2. The recording apparatus according to claim 1, wherein the absorbing material disposing portion is provided on both sides of the liquid receiving portion in the medium width direction.

3. The recording apparatus according to claim 1, wherein the liquid receiving portion is provided corresponding to edges on both sides of the first medium in the medium width direction, and wherein a third region as a region between the two liquid receiving portions in the medium width direction is configured as a liquid receiving portion which receives the liquid emitted in a region deviated from the edge of the first medium in the medium transport direction.

4. The recording apparatus according to claim 1, wherein the support member is provided with a guide portion which guides the liquid from the liquid receiving portion to the absorbing material disposing portion.

5. The recording apparatus according to claim 1, further comprising:

a medium receiving tray which receives the medium discharged after recording, wherein an upstream side of the medium receiving tray in the medium transport direction is positioned under the support member, and wherein the absorbing material disposing portion overlaps the medium receiving tray in an apparatus height direction.

6. The recording apparatus according to claim 1, wherein the liquid absorbing material disposed in the absorbing material disposing portion is held by a holding member having a flange portion.

7. The recording apparatus according to claim 1, wherein a groove extending in the medium width direction is provided on at least one of the upstream side and the downstream side in the medium transport direction in the liquid receiving portion.

* * * * *